US010773913B2

(12) United States Patent
Matsumoto

(10) Patent No.: US 10,773,913 B2
(45) Date of Patent: Sep. 15, 2020

(54) SHEET CONVEYING DEVICE AND IMAGE FORMING APPARATUS INCORPORATING THE SHEET CONVEYING DEVICE

(71) Applicant: Tohru Matsumoto, Kanagawa (JP)

(72) Inventor: Tohru Matsumoto, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/859,837

(22) Filed: Jan. 2, 2018

(65) Prior Publication Data

US 2018/0194581 A1 Jul. 12, 2018

(30) Foreign Application Priority Data

Jan. 11, 2017 (JP) ..... 2017-002601
Jun. 8, 2017 (JP) ..... 2017-113181
Dec. 8, 2017 (JP) ..... 2017-236344

(51) Int. Cl.
*B65H 7/10* (2006.01)
*B65H 9/00* (2006.01)
*B65H 7/08* (2006.01)

(52) U.S. Cl.
CPC ..... *B65H 7/10* (2013.01); *B65H 7/08* (2013.01); *B65H 9/002* (2013.01); *B65H 9/004* (2013.01);
(Continued)

(58) Field of Classification Search
CPC ..... B65H 9/004; B65H 9/006; B65H 9/12; B65H 7/08; B65H 7/10; B65H 2404/1424; B65H 2404/14212
See application file for complete search history.

(56) References Cited

U.S. PATENT DOCUMENTS 8,256,767 B2 * 9/2012 Williams ..... B65H 9/002 271/227
8,292,293 B2 * 10/2012 Inoue ..... B65H 9/002 271/227
(Continued)

FOREIGN PATENT DOCUMENTS

EP 2298674 A2 3/2011
JP 6-234441 8/1994
(Continued)

OTHER PUBLICATIONS

Extended European Search Report dated Jun. 8, 2018 for corresponding European Application No. 17211177.5.

*Primary Examiner* — Michael McCullough
(74) *Attorney, Agent, or Firm* — Harness, Dickey and Pierce, P.L.C.

(57) ABSTRACT

A sheet conveying device, which is included in an image forming apparatus, includes a drive device, a pair of sheet holding rollers to convey a sheet in a sheet conveying direction, a gate to which a leading end of the sheet contacts, a first detector disposed upstream from the pair of sheet holding rollers to detect a position of the sheet and a second detector disposed downstream from the pair of sheet holding rollers to detect a position of the sheet. The pair of sheet holding rollers performs a primary correction to detect and correct a lateral displacement amount of the sheet by moving the pair of sheet holding rollers while holding the sheet, and then performs a secondary correction to detect and correct at least one of a subsequent lateral displacement of the sheet and an angular displacement of the sheet.

23 Claims, 16 Drawing Sheets

(52) U.S. Cl.
CPC ..... *B65H 9/006* (2013.01); *B65H 2404/1424* (2013.01); *B65H 2404/14212* (2013.01); *B65H 2553/416* (2013.01)

(56) References Cited

U.S. PATENT DOCUMENTS

| | | | | |
|---|---|---|---|---|
| 8,905,400 | B2 * | 12/2014 | Umeno | B65H 7/06 271/227 |
| 9,776,819 | B2 * | 10/2017 | Yamane | B65H 9/002 |
| 2005/0012263 | A1 * | 1/2005 | Koyanagi | B65H 7/10 271/227 |
| 2005/0035528 | A1 | 2/2005 | Suga et al. | |
| 2008/0054553 | A1 | 3/2008 | Muneyasu et al. | |
| 2011/0064499 | A1 * | 3/2011 | Johnston | B65H 7/14 399/388 |
| 2011/0316226 | A1 | 12/2011 | Karikusa et al. | |
| 2013/0214482 | A1 | 6/2013 | Matsumoto | |
| 2013/0241141 | A1 | 9/2013 | Karikusa | |
| 2013/0277909 | A1 | 10/2013 | Ino | |
| 2014/0232060 | A1 | 8/2014 | Matsumoto | |
| 2016/0159598 | A1 * | 6/2016 | Yamane | B65H 9/002 271/227 |
| 2017/0149989 | A1 | 5/2017 | Watanabe et al. | |
| 2018/0162667 | A1 * | 6/2018 | Matsuda | B65H 9/20 |
| 2018/0241896 | A1 * | 8/2018 | Watanabe | H04N 1/00602 |
| 2018/0273323 | A1 * | 9/2018 | Yamane | B65H 7/14 |
| 2018/0346271 | A1 * | 12/2018 | Nakamura | B65H 9/002 |
| 2018/0362278 | A1 * | 12/2018 | Matsuda | B65H 9/002 |

FOREIGN PATENT DOCUMENTS

| | | |
|---|---|---|
| JP | 9-175694 | 7/1997 |
| JP | 10-067448 | 3/1998 |
| JP | 10-120253 | 5/1998 |
| JP | 2005-041603 | 2/2005 |
| JP | 2005-041604 | 2/2005 |
| JP | 2005-053646 | 3/2005 |
| JP | 2005-178929 | 7/2005 |
| JP | 2006-027859 | 2/2006 |
| JP | 2007-022806 | 2/2007 |
| JP | 2008-001473 | 1/2008 |
| JP | 2008-050069 | 3/2008 |
| JP | 2011-098790 | 5/2011 |
| JP | 2012-030971 | 2/2012 |
| JP | 2014-019565 | 2/2014 |
| JP | 2014-058369 | 4/2014 |
| JP | 2014-088263 | 5/2014 |
| JP | 2014-193769 | 10/2014 |
| JP | 2015-074550 | 4/2015 |
| JP | 2016-024546 | 2/2016 |
| JP | 2016-044067 | 4/2016 |
| JP | 2016-188142 | 11/2016 |
| JP | 2017-088265 | 5/2017 |
| JP | 2017-114659 | 6/2017 |
| JP | 2017-132583 | 8/2017 |

* cited by examiner

SHEET CONVEYING DEVICE AND IMAGE FORMING APPARATUS INCORPORATING THE SHEET CONVEYING DEVICE

CROSS-REFERENCE TO RELATED APPLICATIONS

This patent application is based on and claims priority pursuant to 35 U.S.C. § 119(a) to Japanese Patent Application Nos. 2017-002601, filed on Jan. 11, 2017, 2017-113181, filed on Jun. 8, 2017, and 2017-236344, filed on Dec. 8, 2017, in the Japan Patent Office, the entire disclosure of each of which is hereby incorporated by reference herein.

BACKGROUND

Technical Field

This disclosure relates to a sheet conveying device that conveys a sheet, and an image forming apparatus such as a copier, printer, facsimile machine, a multi-functional apparatus including at least two functions of the copier, printer, and facsimile machine, and an offset printing machine.

Related Art

Known image forming apparatuses such as copiers and printers employ a sheet conveying device. In a known sheet conveying device, an angular displacement of a sheet (i.e., a positional deviation of a sheet in a radial or rotational direction) is corrected in a sheet conveyance passage first, and a lateral displacement of the sheet (i.e., a positional deviation of a sheet in a width direction that is a direction perpendicular to a sheet conveying direction) is corrected to a normal position.)

To be more specific, in the known sheet conveying device, a sheet that is conveyed through the sheet conveyance passage by multiple pairs of sheet conveying rollers abuts against a stopper, where the correction of angular displacement (skew correction) of the sheet is performed. Consequently, while the sheet in contact with the stopper is being held by a pair of lateral registration correcting rollers (a pair of sheet holding rollers) that is disposed upstream from the stopper in the sheet conveying direction, the sheet is moved in the width direction to correct the lateral displacement. Thereafter, the sheet with the lateral displacement being corrected is conveyed by the pair of lateral registration correcting rollers toward an image forming part while the sheet is being held by the pair of lateral registration correcting rollers.

The above-described known technique, however, has a chance that the sheet is displaced in the rotation direction and the width direction of the sheet again while the sheet after the corrections of angular and lateral displacements is held and conveyed by the pair of sheet holding rollers (the pair of lateral registration correcting rollers).

SUMMARY

At least one aspect of this disclosure provides a sheet conveying device including a drive device, a pair of sheet holding rollers, a gate, a first detector and a second detector. The pair of sheet holding rollers is rotated by the drive device and is configured to convey a sheet, while holding the sheet, in a sheet conveying direction. The gate is a member to which a leading end of the sheet being conveyed in a sheet conveyance passage contacts. The first detector is disposed upstream from the pair of sheet holding rollers in the sheet conveying direction and is configured to detect a position of the sheet conveyed in the sheet conveyance passage. The second detector is disposed downstream from the pair of sheet holding rollers in the sheet conveying direction and is configured to detect a position of the sheet conveyed in the sheet conveyance passage. The pair of sheet holding rollers performs a primary correction in which (1) the leading end of the sheet contacts the gate; (2) the first detector detects the position of the sheet and obtains a lateral displacement amount of the sheet; and (3) the pair of sheet holding rollers moves, while holding the sheet, in a width direction based on a detection result of the first detector. The pair of sheet holding rollers performs a secondary correction, after the primary correction, in which (1) the first detector and the second detector detect a subsequent position of the sheet and obtain a subsequent lateral displacement amount of the sheet and an angular displacement amount while the pair of sheet holding rollers is holding the sheet; and (2) the pair of sheet holding rollers moves in at least one of the width direction and a rotation direction based on a detection result of the first detector and the second detector.

Further, at least one aspect of this disclosure provides an image forming apparatus including the above-described sheet conveying device.

Further, at least one aspect of this disclosure provides a sheet conveying device including a drive device, a pair of sheet holding rollers, a gate, a first detector, a second detector and a controller. The pair of sheet holding rollers is rotated by the drive device and is configured to convey a sheet, while holding the sheet, in a sheet conveying direction. The gate is a member to which a leading end of the sheet being conveyed in a sheet conveyance passage contacts. The first detector is disposed upstream from the pair of sheet holding rollers in the sheet conveying direction and is configured to detect a position of the sheet conveyed in the sheet conveyance passage. The second detector is disposed downstream from the pair of sheet holding rollers in the sheet conveying direction and is configured to detect a position of the sheet conveyed in the sheet conveyance passage. The controller is configured to control a movement of the pair of sheet holding rollers based on at least one of a detection result of the first detector and a detection result of the second detector. The controller, after the leading end of the sheet contacts the gate and the sheet is held by the pair of sheet holding members, causes (1) the pair of sheet holding rollers to move in a width direction of the sheet based on the detection result of the first detector; and (2) the pair of sheet holding rollers to move at least one of the width direction of the sheet and a rotation direction of the sheet based on the detection result of the first detector and the detection result of the second detector while the sheet is being conveyed by the pair of sheet holding rollers.

Further, at least one aspect of this disclosure provides an image forming apparatus including the above-described sheet conveying device.

BRIEF DESCRIPTION OF THE SEVERAL VIEWS OF THE DRAWINGS

An exemplary embodiment of this disclosure will be described in detail based on the following figured, wherein.

DETAILED DESCRIPTION

Figure 1:
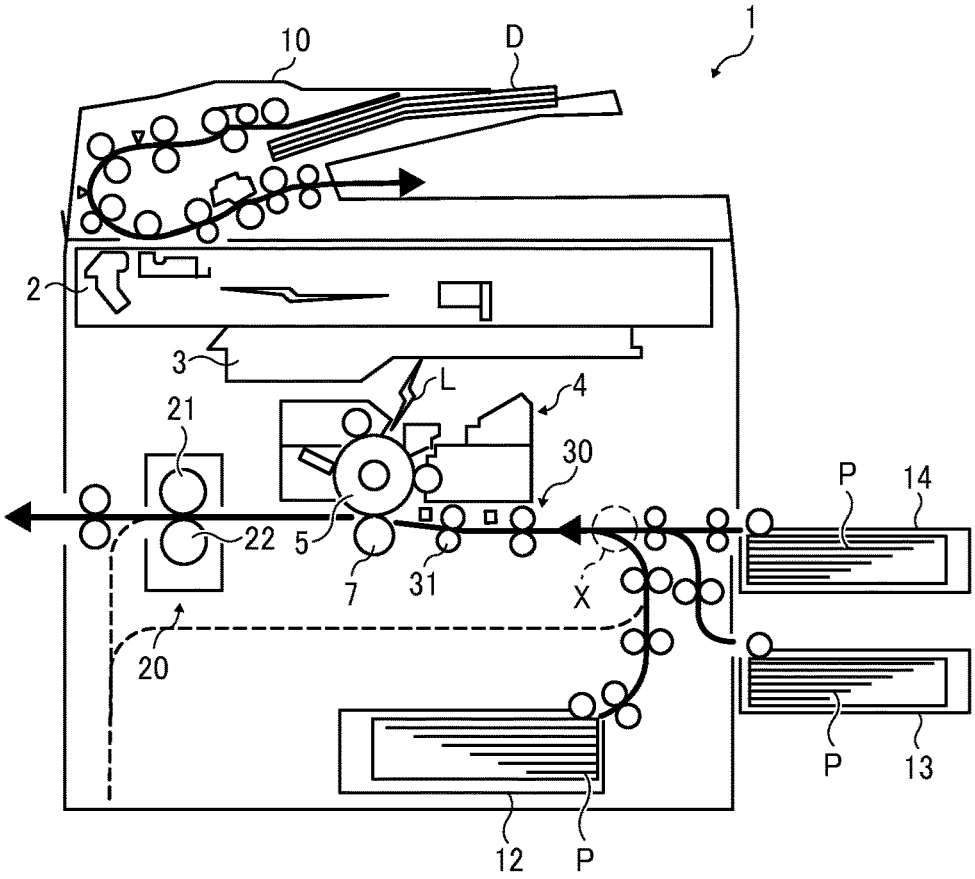
FIG. 1 is a diagram illustrating an overall configuration of an image forming apparatus according to Embodiment 1 of this disclosure.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present disclosure.

The terminology used herein is for describing particular embodiments and examples and is not intended to be limiting of exemplary embodiments of this disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of this disclosure. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of this disclosure.

This disclosure is applicable to any image forming apparatus, and is implemented in the most effective manner in an electrophotographic image forming apparatus.

In describing preferred embodiments illustrated in the drawings, specific terminology is employed for the sake of clarity. However, the disclosure of this disclosure is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of this disclosure are described.

Next, a description is given of a configuration and functions of an image forming apparatus according to an embodiment of this disclosure, with reference to drawings. It is to be noted that identical parts are given identical reference numerals and redundant descriptions are summarized or omitted accordingly.

Embodiment 1

A description is given of a configuration and functions of an image forming apparatus according to Embodiment 1 of this disclosure, with reference to FIGS. 1 through 7.

It is to be noted that elements (for example, mechanical parts and components) having the same functions and shapes are denoted by the same reference numerals throughout the specification and redundant descriptions are omitted.

Now, a description is given of an overall configuration and operations of an image forming apparatus 1 according to an embodiment of this disclosure, with reference to FIG. 1.

FIG. 1 is a diagram illustrating a schematic configuration of the image forming apparatus 1 according to Embodiment 1 of this disclosure.

The image forming apparatus 1 may be a copier, a facsimile machine, a printer, a multifunction peripheral or a multifunction printer (MFP) having at least one of copying, printing, scanning, facsimile, and plotter functions, or the like. According to the present example, the image forming apparatus 1 is an electrophotographic copier that forms toner images on recording media by electrophotography.

It is to be noted in the following examples that: the term "image forming apparatus" indicates an apparatus in which an image is formed on a recording medium such as paper, OHP (overhead projector) transparencies, OHP film sheet, thread, fiber, fabric, leather, metal, plastic, glass, wood, and/or ceramic by attracting developer or ink thereto; the term "image formation" indicates an action for providing (i.e., printing) not only an image having meanings such as texts and figures on a recording medium but also an image having no meaning such as patterns on a recording medium; and the term "sheet" is not limited to indicate a paper material but also includes the above-described plastic material (e.g., a OHP sheet), a fabric sheet and so forth, and is used to which the developer or ink is attracted. In addition, the "sheet" is not limited to a flexible sheet but is applicable to a rigid plate-shaped sheet and a relatively thick sheet.

Further, size (dimension), material, shape, and relative positions used to describe each of the components and units are examples, and the scope of this disclosure is not limited thereto unless otherwise specified.

Further, it is to be noted in the following examples that: the term "sheet conveying direction" indicates a direction in which a recording medium travels from an upstream side of a sheet conveying path to a downstream side thereof; the term "width direction" indicates a direction basically perpendicular to the sheet conveying direction.

In FIG. 1, the image forming apparatus 1 includes a document reading device 2, an exposure device 3, an image forming device 4, a photoconductor drum 5, a transfer roller 7, a document conveying unit 10, a first sheet feeding unit 12, a second sheet feeding unit 13, a third sheet feeding unit 14, a fixing device 20, a fixing roller 21, a pressure roller 22, a sheet conveying device 30, and a pair of sheet holding rollers 31.

The document reading device 2 optically reads image data of an original document D.

The exposure device 3 emits an exposure light L based on the image data read by the document reading device 2 to irradiate the exposure light L onto a surface of the photoconductor drum 5 that functions as an image bearer.

The image forming device 4 forms a toner image on the surface of the photoconductor drum 5.

The transfer roller 7 functions as a transfer unit to transfer the toner image formed on the surface of the photoconductor drum 5 onto a sheet P.

The photoconductor drum 5 that functions as an image bearer and the transfer roller 7 that functions as a transfer unit are included in the image forming device 4.

The document conveying unit 10 conveys the original document D set on a document tray or loader to the document reading device 2.

The first sheet feeding unit 12, the second sheet feeding unit 13, and the third sheet feeding unit 14 are sheet trays, each of which contains the sheet P (a recording medium P) therein.

The fixing device 20 includes the fixing roller 21 and the pressure roller 22 to fix an unfixed image formed on the sheet P to the sheet P by application of heat by the fixing roller 21 and pressure by the pressure roller 22.

The sheet conveying device 30 conveys the sheet P through a sheet conveyance passage.

The pair of sheet holding rollers 31 functions as a pair of rotary bodies (e.g., a pair of registration rollers and a pair of timing rollers) to convey the sheet P to the transfer roller 7. The pair of sheet holding rollers 31 is also referred to as a pair of angular and lateral displacement correction rollers.

Now, a description is given of regular image forming operations performed by the image forming apparatus 1, with reference to FIG. 1.

The original document D is fed from a document loading table provided to the document conveying unit 10 and conveyed by multiple pairs of sheet conveying rollers disposed in the document conveying unit 10 in a direction indicated by arrow in FIG. 1 over the document reading device 2. At this time, the document reading device 2 optically reads image data of the original document D passing over the document reading device 2.

Consequently, the image data optically scanned by the document reading device 2 is converted to electrical signals. The converted electrical signals are transmitted to the exposure device 3 by which the image is optically written. Then, the exposure device 3 emits the exposure light (laser light) L based on the image data of the electrical signals toward the surface of the photoconductor drum 5 of the image forming device 4.

By contrast, the photoconductor drum 5 of the image forming device 4 rotates in a clockwise direction in FIG. 1. After a series of predetermined image forming processes, e.g., a charging process, an exposing process, and a developing process is completed, a toner image corresponding to the image data is formed on the surface of the photoconductor drum 5.

Then, the toner image formed on the surface of the photoconductor drum 5 is transferred onto the sheet P that is conveyed by the pair of sheet holding rollers 31 that functions as a pair of registration rollers, in a transfer nip region (i.e., an image forming area) in which the transfer roller 7 and the photoconductor drum 5 contact to each other.

Figure 2:
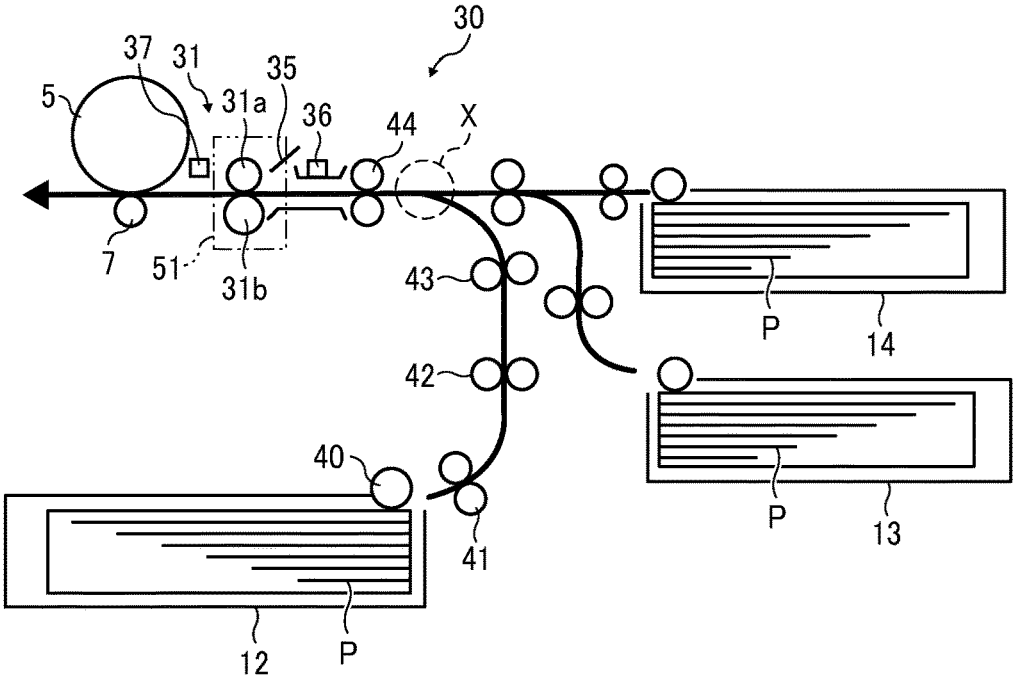
FIG. 2 is a schematic diagram illustrating a sheet conveying device included in the image forming apparatus of FIG. 1.

Now, referring to FIGS. 1 and 2, a description is given of movement of the sheet P to be conveyed to the transfer roller 7 (i.e., the image forming area).

As illustrated in FIGS. 1 and 2, one of the first sheet feeding unit 12, the second sheet feeding unit 13 and the third sheet feeding unit 14 of the image forming apparatus 1 is selected automatically or manually. It is to be noted that the first sheet feeding unit 12, the second sheet feeding unit 13 and the third sheet feeding unit 14 basically have an identical configuration to each other, except the second sheet feeding unit 13 and the third sheet feeding unit 14 disposed outside an apparatus body of the image forming apparatus 1. The following description is given of an operation in a case when the first sheet feeding unit 12 disposed inside the apparatus body of the image forming apparatus 1 is selected.

Consequently, when the first sheet feeding unit 12 of the image forming apparatus 1 is selected, an uppermost sheet P contained in the first sheet feeding unit 12 is fed by a sheet feed roller 40 toward a curved sheet conveyance passage having a first pair of sheet conveying rollers 41, a second pair of sheet conveying rollers 42 and a third pair of sheet conveying rollers 43.

The sheet P travels in the curved sheet conveying passage toward a merging point X where the sheet conveying passage of the sheet P fed from the first sheet feeding unit 12 and respective sheet conveying passages of the sheet P fed from the second sheet feeding unit 13 and the third sheet feeding unit 14 disposed outside an apparatus body of the image forming apparatus 1 merge. After passing the merging point X, the sheet P passes a straight sheet conveying passage in which a third pair of sheet conveying rollers 44 (i.e., a pair of upstream side sheet conveying rollers) and a alignment unit 51 are disposed, and reaches the alignment unit 51. Then, the pair of sheet holding rollers 31, which is provided to the alignment unit 51, performs the correction of angular displacement of the sheet P and the correction of lateral displacement of the sheet P. The sheet P is then conveyed toward the transfer roller 7 (i.e., a transfer nip region) in synchronization with movement of the toner image formed on the surface of the photoconductor drum 5 for positioning.

After completion of a transfer process, the sheet P passes the transfer roller 7 and reaches the fixing device 20 through the sheet conveyance passage. In the fixing device 20, the sheet P is inserted into a fixing nip region between the fixing roller 21 and the pressure roller 22, so that the toner image is fixed to the sheet P by application of heat applied by the fixing roller 21 and pressure applied by the fixing roller 21 and the pressure roller 22. After having been discharged from the fixing nip region of the fixing device 20, the sheet P having the toner image fixed thereto is ejected from an apparatus body of the image forming apparatus 1 onto a sheet ejection tray.

Accordingly, a series of image forming processes is completed.

It is to be noted that, in a case in which a single side printing mode in which an image is formed on one side of the sheet P, the sheet P is discharged outside after the image is fixed to the sheet P (i.e., the fixing process). By contrast, in a case in which a duplex printing mode in which respective images are printed both sides (i.e., a front side and a back side) of the sheet P is selected, after completion of the fixing process for the front side of the sheet P, the sheet P is not discharged after the fixing process but is guided to a duplex sheet conveyance passage indicated with a broken line in FIG. 1, so that the sheet P is conveyed toward the transfer roller 7 (i.e., the transfer nip region) after the direction of conveyance of the sheet P has been changed. After a series of given image forming processes, e.g., a charging process, an exposing process, and a developing process, a toner image corresponding to the image data is formed on the back side of the sheet P. Then, the sheet P with the toner image fixed thereto passes a fixing nip region (i.e., a fixing process), and is then discharged from the image forming apparatus 1.

As illustrated in FIG. 2, the image forming apparatus 1 according to Embodiment 1 of this disclosure feeds the sheet P from any selected one of the first sheet feeding unit 12, the second sheet feeding unit 13, and the third sheet feeding unit 14 toward the transfer roller 7 (i.e., an image forming area on the sheet P).

Further, each of multiple pairs of conveying rollers including the first pair of sheet conveying rollers 41, the second pair of sheet conveying rollers 42, the third pair of sheet conveying rollers 43 and the fourth pair of sheet conveying rollers 44 provided to the sheet conveying device 30 includes a driving roller and a driven roller as a pair. The driving roller is driven and rotated by a driving mechanism and a driven roller is rotated with the driving roller by a frictional resistance with the driving roller. According to this configuration, the sheet P is conveyed while being held between these two rollers. The transfer roller 7 contacts the photoconductor drum 5 in the image forming area to the sheet P (i.e., the transfer nip region) with a predetermined transfer bias applied thereto, rotates in a counterclockwise direction in FIG. 1, and the toner image borne on the surface of the photoconductor drum 5 is transferred onto the surface of the sheet P while conveying the sheet P held between the photoconductor drum 5 and the transfer roller 7.

As described above, the image forming apparatus 1 includes a straight sheet conveying passage extending substantially linearly along the sheet conveying direction of sheet P. The straight sheet conveying passage is a sheet conveying passage from the merging point X, where a branched sheet conveying passage from the first sheet feeding unit 12 and the other branched sheet conveying passages from the second sheet feeding unit 13 and the third sheet feeding unit 14 merge, to the transfer roller 7 (i.e., the image forming area to the sheet P). The straight sheet conveying passage is mainly defined by straight conveying guide plates that are disposed facing each other and in parallel to the sheet conveying direction. The straight conveying guide plates hold both sides (i.e., the front side and the back side) of the sheet P therebetween while the sheet P is being conveyed. Multiple contact image sensors (hereinafter, a contact image sensor is referred to as a CIS) that are position detectors to detect the sheet P at respective positions are disposed along the sheet conveying direction. Specifically, the fourth pair of sheet conveying rollers 44 (i.e., the pair of upstream side sheet conveying rollers), a first CIS 36, a sloped conveying guide plate 35 (i.e., a sheet conveying guide plate), the pair of sheet holding rollers 31 (i.e., the alignment unit 51) and a second CIS 37 are disposed in this order to a downstream side in the sheet conveying direction. Both the fourth pair of sheet conveying rollers 44 and the pair of sheet holding rollers 31 are pair rollers including a drive roller and a driven roller. The drive roller and the driven roller of each of the fourth pair of sheet conveying rollers 44 and the pair of sheet holding rollers 31 convey the sheet P while holding the sheet P in a nip region formed therebetween. The pair of sheet holding rollers 31 is included in and also acts as the alignment unit 51 to align positional deviation, that is, to perform the correction of angular displacement of the sheet P (i.e., the correction of a positional deviation of the sheet P in the direction of rotation of the pair of sheet holding rollers 31 on a plane parallel to the sheet P to be conveyed in the sheet conveying direction) and the correction of lateral displacement of the sheet P (i.e., the correction of a positional deviation of the sheet P in the width direction). Details of the operations of the pair of sheet holding rollers 31 (i.e., the alignment unit 51) will be described below.

Next, a detailed description is given of the sheet conveying device 30 (a large capacity sheet feeding device) according to an embodiment of this disclosure, with reference to FIGS. 2 through 6.

Specifically, a configuration, functions, and operations of the sheet conveying device 30 from the merging point X to the transfer roller 7 (i.e., an image forming area) are described.

Figure 3:
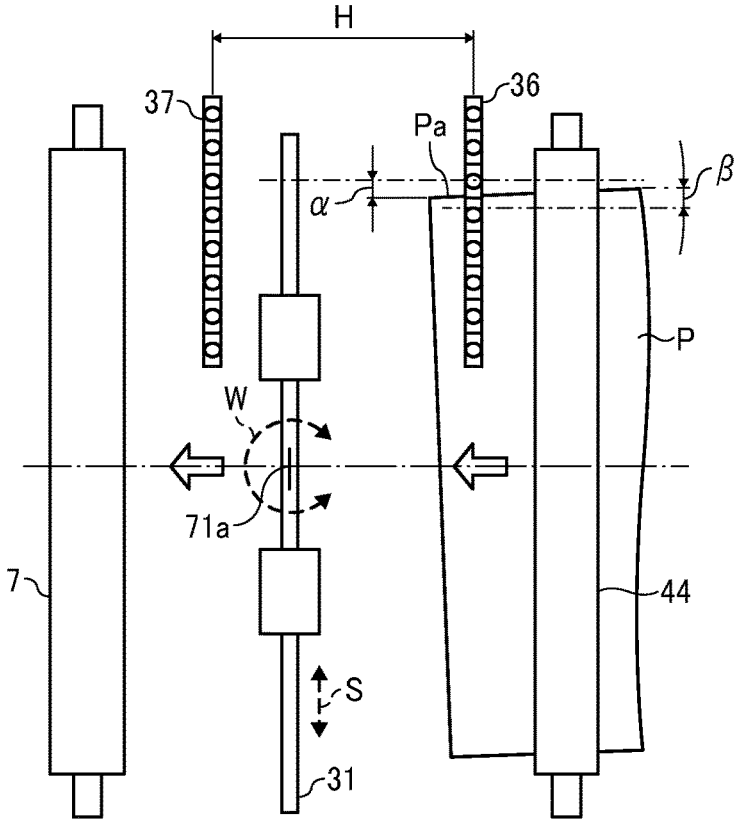
FIG. 3 is a top view illustrating the sheet conveying device.

As illustrated in FIGS. 2 and 3, the sheet conveying device 30 includes a fourth pair of sheet conveying rollers 44 that functions as a pair of upstream side sheet conveying rollers, a first CIS 36 that functions as a first detector, a sloped conveying guide plate 35 that functions as a sheet conveying guide plate, the pair of sheet holding rollers 31 that functions as the alignment unit 51 and a pair of registration rollers, and a second CIS 37 that functions as a second detector, along the straight sheet conveyance passage (extending from the merging point X to the transfer roller 7) of the sheet P. The first CIS 36 and the second CIS 37 are contact image sensors aligned in the width direction (i.e., a direction perpendicular to a drawing sheet of FIG. 2 and a vertical direction of FIG. 3) of the sheet P. Each contact image sensor (CIS) includes multiple photosensors to optically detect a side end (an edge portion) of the sheet P that is passing the position where the CIS is disposed.

The pair of sheet holding rollers 31 is one of multiple roller pairs of sheet holding rollers 31 that are divided in the width direction of the sheet P. Specifically, the pair of sheet holding rollers 31 includes a drive roller 31*a* and a driven roller 31*b*. The drive roller 31*a* is driven to rotate by a first drive motor 61 (see FIG. 4) that functions as a first driving device. The driven roller 31*b* is rotated together with the drive roller 31*a*. A nip region is formed between the drive roller 31*a* and the driven roller 31*b* to hold and convey the sheet P. That is, the pair of sheet holding rollers 31 conveys the sheet P by rotating while holding the sheet P between the drive roller 31*a* and the driven roller 31*b*. It is to be noted that, for convenience, the multiple pairs of sheet holding rollers 31 are expressed in a singular form as the pair of sheet holding rollers 31 in this disclosure.

It is to be noted that, the pair of sheet holding rollers 31 in Embodiment 1 has rollers divided in the width direction thereof. However, the structure of a pair of sheet holding rollers is not limited thereto. For example, a pair of sheet holding rollers that is not divided in the width direction but extends over the whole width thereof can be applied to this disclosure.

In addition, the pair of sheet holding rollers 31 rotates about a shaft on a sheet conveyance plane of the sheet P (i.e., a direction indicated by a dotted arrow W in FIG. 3) and moves in the width direction of the sheet P (i.e., a direction indicated by a dotted arrow S in FIG. 3).

Figure 4:
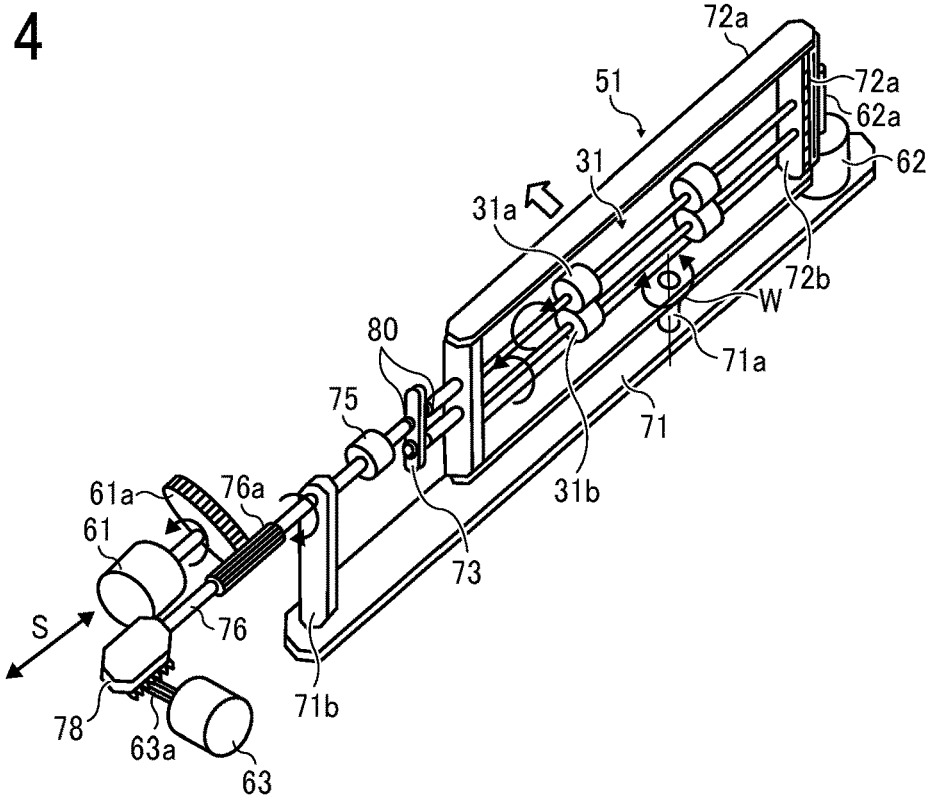
FIG. 4 is a perspective view illustrating a main part of the sheet conveying device.

Specifically, as illustrated in FIG. 4, the pair of sheet holding rollers 31 having the drive roller 31*a* and the driven roller 31*b* is driven to rotate by the first drive motor 61 that functions as a first driving device, so as to convey the sheet P while holding the sheet P between the drive roller 31*a* and the driven roller 31*b*.

To be more specific, the first drive motor 61 is fixedly mounted on a frame of the sheet conveying device 30 of the image forming apparatus 1. The first drive motor 61 includes a motor shaft and a driving gear 61*a* that is mounted on the motor shaft. The driving gear 61*a* meshes with a gear 76*a* of a frame side rotary shaft 76. The gear 76*a* of the frame side rotary shaft 76 is rotationally supported to an uprising portion 71*b* of a base 71 of the frame. The first drive motor 61 rotates the frame side rotary shaft 76 in a direction indicated by arrow in FIG. 4. As the frame side rotary shaft 76 is driven and rotated, a rotational driving force applied by the rotation of the frame side rotary shaft 76 is transmitted to a rotary shaft of the drive roller 31*a* via a coupling 75. This transmission rotates the rotary shaft of the drive roller 31*a*. Accordingly, the driven roller 31*b* is rotated with the drive roller 31*a*.

The coupling 75 is disposed between the rotary shaft of the drive roller 31*a* and the frame side rotary shaft 76 rotationally supported by the base 71 of the frame of the sheet conveying device 30. The coupling 75 is a shaft coupling such as a constant velocity (universal) joint and a universal joint. With the coupling 75, when a second drive motor 62 is driven, the pair of sheet holding rollers 31 rotates together with a holding member 72. With this configuration, even if a shaft angle of the rotary shaft of the drive roller 31*a* and the frame side rotary shaft 76 is changed, a speed of rotation does not change, and therefore the rotational driving force is transmitted successfully.

Further, the first drive motor 61 that functions as a drive device drives and rotates the pair of sheet holding rollers 31 at a predetermined time and stops the rotation of the pair of sheet holding rollers 31, based on control by a controller 160. While the rotation of the pair of sheet holding rollers 31 performed by the first drive motor 61 is being stopped, the leading end of the sheet P that is conveyed toward the pair of sheet holding rollers 31 contacts the nip region of the pair of sheet holding rollers 31 (i.e., a contact portion at which the drive roller 31*a* and the driven roller 31*b* contact with each other). By so doing, a positional deviation amount β of angular displacement of the sheet P is corrected. That is, the pair of sheet holding rollers 31 in Embodiment 1 also functions as a gate to which the leading end of the sheet P conveyed in the sheet conveyance passage contacts.

Specifically, the leading end of the sheet P that is conveyed by the fourth pair of sheet conveying rollers 44 that functions as a pair of upstream side sheet conveying rollers toward the pair of sheet holding rollers 31 contacts the nip region of the pair of sheet holding rollers 31 that functions as a gate while the rotation of the pair of sheet holding rollers 31 is stopped. By further conveying the sheet P in this state by the fourth pair of sheet conveying rollers 44, the sheet P is upwardly curved in the sheet conveying direction along the slope of the sloped conveying guide plate 35 (i.e., an upward curve of the sheet P as illustrated in FIG. 5D. Accordingly, the angular displacement of the sheet P is corrected. In other words, even when the sheet P is conveyed in a state in which the sheet P is obliquely directed (offset) from the sheet conveying direction or is skewed, one end of the leading end of the sheet P firstly contacts the nip region of the pair of sheet holding rollers 31 that functions as a gate. As the sheet P rotates about the one end of the leading end thereof, the other end of the sheet P then contacts the nip region of the pair of sheet holding rollers 31, and therefore the angular displacement of the sheet P is corrected eventually.

It is to be noted that the sloped conveying guide plate 35 that functions as a sheet conveying guide plate is disposed upstream from the pair of sheet holding rollers 31 in the sheet conveyance passage in the sheet conveying direction. Specifically, the sloped conveying guide plate 35 is disposed at an upward side and slanted downwardly from the upstream side end to the downstream side end toward the pair of sheet holding rollers 31. The straight conveying guide plates are disposed below the sloped conveying guide plate 35 in the sheet conveying direction with the sheet conveyance passage therebetween. The straight conveying guide plates are disposed adjacent to and upstream from the sloped conveying guide plate 35 in the sheet conveying direction.

Consequently, the sloped conveying guide plate 35 guides the sheet P so that the sheet P that contacts the pair of sheet holding rollers 31 in a stop state in which the first drive motor 61 (i.e., the drive unit) has halted the rotation of the pair of sheet holding rollers 31.

The holding member 72 is a movable body having a substantially rectangular shape. The pair of sheet holding rollers 31 is rotationally supported by the holding member 72 and is movably supported in the width direction thereof. Specifically, both ends of the rotary shaft of each of the drive roller 31*a* and the driven roller 31*b* of the pair of sheet holding rollers 31 in the width direction are rotationally supported to the holding member 72 via respective bearings that are fixedly mounted on the holding member 72. Further, the drive roller 31*a* and the driven roller 31*b* are supported by the holding member 72 to be movable in the width direction (an extending direction of the rotary shafts) of the drive roller 31*a* and the driven roller 31*b*. Specifically, a sufficient gap is provided between a supporting part 72*b* disposed at one end of the holding member 72 and a gear 72*a*, so that the respective rotary shafts of the drive roller 31*a* and the driven roller 31*b* does not interfere with the gear 72*a* even if the drive roller 31*a* and the driven roller 31*b* slide to the one end in the width direction.

Further, the holding member 72 is rotationally supported about the shaft 71*a* to the base 71 that functions as part of the frame of the sheet conveying device 30 of the image forming apparatus 1. Further, the second drive motor (a rotary motor) 62 that functions as a second driving unit is fixedly mounted on one end in the width direction of the base 71. The second drive motor 62 has a motor shaft 62*a* on which a gear is mounted. The gear mounted on the motor shaft 62*a* meshes with the gear 72*a* that is disposed at one end in the width direction of the holding member 72. With this structure, as the second drive motor 62 drives to rotate in a forward direction or in a backward direction, the pair of sheet holding rollers 31 rotates about the shaft 71*a* to the angularly oblique side in the direction W together with the holding member 72 as illustrated in FIGS. 3 and 4. The second drive motor 62 that functions as a second driving unit is driven to rotate the holding member 72 to the angularly oblique side in the sheet conveying direction W together with the pair of sheet holding rollers 31 based on results detected by the respective CISs, which are the first CIS 36 and the second CIS 37.

It is to be noted that a known encoder is mounted on the motor shaft of the second drive motor 62, so that degree and direction of rotation of the pair of sheet holding rollers 31 to the rotation side to sheet P in the sheet conveying direction with respect to a normal position are detected indirectly. Accordingly, the pair of sheet holding rollers 31 can perform the angular displacement correction performed by the pair of sheet holding rollers 31 based on the results detected by the respective CISs, which are the first CIS 36 and the second CIS 37. Specifically, the second drive motor 62 on which the encoder is mounted functions as a movement amount detector to detect an amount of movement of the pair of sheet holding rollers 31 in the direction of rotation of the pair of sheet holding rollers 31.

It is to be noted that the pair of sheet holding rollers 31 (of the holding member 72) according to Embodiment 1 rotates about the center of the pair of sheet holding rollers 31 in the width direction. However, the configuration of the pair of sheet holding rollers 31 is not limited thereto. For example, the pair of sheet holding rollers 31 (of the holding member 72) may rotate about an end of the pair of sheet holding rollers 31 in the width direction.

A rack gear 78 is disposed at the other end in the width direction of the frame side rotary shaft 76 that is rotatably supported by the base 71 (i.e., the frame) and meshes with a pinion gear that is mounted on a motor shaft 63*a* of a third drive motor (a shift motor) 63 that functions as a third driving unit. The rack gear 78 that is rotationally disposed relative to the frame side rotary shaft 76 is supported by the frame, so as to slide without rotating together with the frame side rotary shaft 76 in the width direction (i.e., the direction S illustrated in FIGS. 3 and 4), along a guide rail that is formed on the frame of the sheet conveying device 30. Similar to the first drive motor 61 and the second drive motor 62, the third drive motor 63 that functions as a third driving unit is fixed to the frame of the sheet conveying device 30 of the image forming apparatus 1.

By contrast, a link 73 is disposed between the coupling 75 and a supporting part disposed at the other end of the holding member 72. The link 73 rotatably connects the drive roller 31*a* and the driven roller 31*b* so that the drive roller 31*a* and the driven roller 31*b* move together with each other in the width direction S. Specifically, the link 73 is held between retaining rings 80 disposed at respective gutters formed on the rotary shaft of the drive roller 31*a* and the rotary shaft of the driven roller 31*b*. As the drive roller 31*a* moves in the width direction, the driven roller 31*b* is moved together with the drive roller 31*a* in the width direction by the same distance as the drive roller 31*a*.

With this configuration, the pair of sheet holding rollers 31 moves in the width direction (i.e., the direction S in FIGS. 3 and 4) along with rotation of the third drive motor 63 in the forward and backward directions. The third drive motor 63 that functions as a third driving unit causes the pair of sheet holding rollers 31 to move together with the frame side rotary shaft 76 in the width direction based on the results detected by the first detector and the second detector, which are the first CIS 36 and the second CIS 37, respectively, as described below.

It is to be noted that a known encoder is mounted on the motor shaft of the third drive motor 63 (i.e., a shift motor), so that the degree and direction of rotation of the pair of sheet holding rollers 31 in the width direction with respect to the normal position are detected indirectly. Accordingly, the pair of sheet holding rollers 31 can perform the correction of lateral displacement based on the results detected by the first detector (i.e., the first CIS 36) and the second detector (i.e., the second CIS 37). That is, the third drive motor 63 on which the encoder is mounted functions as a movement amount detector to detect the amount of movement of the pair of sheet holding rollers 31 in the width direction.

When the leading end of the sheet P conveyed toward the pair of sheet holding rollers 31 contacts the pair of sheet holding rollers 31 while the rotation of the pair of sheet holding rollers 31 by the first drive motor 61 that functions as a drive device is being stopped, the positional deviation amount (beta) of angular displacement of the sheet P is corrected. Thereafter, the pair of sheet holding rollers 31 moves in the width direction while holding the sheet P so that a positional deviation amount (alpha) in the width direction of the sheet P is corrected based on the detection result of the first detector, i.e., the first CIS 36.

To be more specific, after the positional deviation amount of angular displacement of the sheet P is corrected by abutting the leading end of the sheet P conveyed toward the pair of sheet holding rollers 31 contacts the pair of sheet holding rollers 31 while the rotation of the pair of sheet holding rollers 31 by the first drive motor 61 that functions as a drive device is being stopped, the first detector (i.e., the first CIS 36) detects the positional deviation amount of the sheet P in the width direction while the pair of sheet holding rollers 31 is holding the sheet P. Then, based on the detection result of the first detector (i.e., the first CIS 36), the pair of sheet holding rollers 31 moves from a normal position (a position in FIG. 5A) to a corrected position (a position in FIG. 5G) while holding and conveying the sheet P.

That is, the pair of sheet holding rollers 31 functions as a first corrector to receive the leading end of the sheet P while the rotation of the pair of sheet holding rollers 31 is stopped, so as to correct the angular displacement of the sheet P and, at the same time, to correct the lateral displacement of the sheet P by moving in the width direction of the sheet P while holding and conveying the sheet P.

Then, the first detector (i.e., the first CIS 36) and the second detector (i.e., the second CIS 37) detect a supplemental positional deviation amount in the width direction and the rotation direction of the sheet P after the positional deviation amount in the rotation direction and the width direction are corrected by the pair of sheet holding rollers 31. The pair of sheet holding rollers 31 moves in the width direction and the rotation direction of the sheet P while holding the sheet P such that the positional deviations (i.e., the angular displacement and the lateral displacement) of the sheet P are further corrected based on the detection results.

To be more specific, after the positional deviation amount in the rotation direction and the width direction of the sheet P is corrected by the pair of sheet holding rollers 31 that functions as a first corrector, the first detector (i.e., the first CIS 36) and the second detector (i.e., the second CIS 37) sequentially detect the positional deviation amount in the width direction and the rotation direction of the sheet P while the pair of sheet holding rollers 31 is holding and conveying the sheet P. Then, while holding and conveying the sheet P, the pair of sheet holding rollers 31 moves from the corrected position (the position in FIG. 5G) to the second correction position (a position in FIG. 6C) in the width direction and the rotation direction of the sheet P such that the positional deviation amount in the width direction and the rotation direction of the sheet P is further corrected by a feedback control based on the detection result.

That is, after the primary correction is performed, the pair of sheet holding rollers 31 performs a second corrector to rotate in the rotation direction of the sheet P to correct the angular displacement of the sheet P and, at the same time, move in the width direction of the sheet P while holding and conveying the sheet P.

As described above, in Embodiment 1, the leading end of the sheet P contacts the pair of sheet holding rollers 31 that functions as a gate first. Then, based on the detection result of the first CIS 36 that functions as a first detector, the pair of sheet holding rollers 31 is moved in the width direction while holding the sheet P, so as to perform a primary correction to correct the position of the sheet P. This operation is referred to as a "primary correction." Then, after the primary correction, the first CIS 36 that functions as a first detector and the second CIS 37 that functions as a second detector detect the position of the sheet P while the sheet P is being held by the pair of sheet holding rollers 31. Based on the detection result of the first CIS 36 and the second CIS 37, the pair of sheet holding rollers 31 is moved in the width direction and the rotation direction of the sheet P. This operation is referred to as a "secondary correction."

That is, after having performed the correction of angular displacement and the correction of lateral displacement as the primary correction, the pair of sheet holding rollers 31 that also functions as a gate performs the correction of angular displacement of the sheet P and the correction of lateral displacement of the sheet P again as the secondary correction (in other words, a "recorrection"). By so doing, the accuracy of the correction of angular displacement of the sheet P and the accuracy of the correction of lateral displacement of the sheet P are enhanced respectively, before the sheet P reaches the image forming area.

Further in other words, the sheet conveying device 30 includes the controller 160 that controls operations performed by the pair of sheet holding rollers 31 based on at least one of the detection result of the first CIS 36 that functions as a first detector and the detection result of the second CIS 37 that functions as a second detector.

Then, the leading end of the sheet P contacts the pair of sheet holding rollers 31 that functions as a gate. After the sheet P is held by the pair of sheet holding rollers 31, the controller 160 causes the pair of sheet holding rollers 31 to move in the width direction based on the detection result of the first CIS 36. Then, the controller 160 causes the pair of sheet holding rollers 31 to move in the width direction and the rotation direction of the sheet P based on the detection result of the first CIS 36 and the detection result of the second CIS 37 while the pair of sheet holding rollers 31 is holding the sheet P.

The fourth pair of sheet conveying rollers 44 that functions as a pair of upstream side sheet conveying rollers is disposed upstream from the pair of sheet holding rollers 31 in the sheet conveying direction (i.e., at the upstream side of the sheet conveying direction). The fourth pair of sheet conveying rollers 44 is a pair of sheet conveying rollers that conveys the sheet P by rotating while holding the sheet P and that the rollers thereof are separatable to switch between a sheet holding state and a non sheet holding state. After the sheet P contacts the pair of sheet holding rollers 31 so that the angular displacement of the sheet P is corrected and then the pair of sheet holding rollers 31 holds and conveys the sheet P, the fourth pair of sheet conveying rollers 44 is switched from the sheet holding state to the non sheet holding state.

In Embodiment 1, the pair of sheet holding rollers 31 also functions as a pair of registration rollers that is disposed upstream from the transfer roller 7 that functions as a downstream side sheet conveying roller in the sheet conveyance passage in the sheet conveying direction. By rotating while holding the sheet P, the pair of sheet holding rollers 31 conveys the sheet P (i.e., the sheet P after the pair of sheet holding rollers 31 has corrected the angular displacement and the lateral displacement) toward the image forming area.

The first drive motor 61 that drives and rotates (the drive roller 31*a* of) the pair of sheet holding rollers 31 is a drive motor with variable number of rotations to change a speed of conveyance of the sheet P. Then, when a sheet detecting sensor that is a photosensor detects the timing of arrival of the sheet P at the pair of sheet holding rollers 31, that is, when a state in which the sheet P contacts the nip region of the pair of sheet holding rollers 31, the pair of sheet holding rollers 31 corrects the angular displacement of the sheet P, and the pair of sheet holding rollers 31 holds the sheet P is detected), while correcting the lateral displacement of the sheet P in the primary correction and correcting the lateral displacement and the angular displacement of the sheet P in the secondary correction, the pair of sheet holding rollers 31 changes the speed of conveyance of the sheet P based on the detection result (that is, the timing of arrival of the sheet P at the pair of sheet holding rollers 31) of the sheet detecting sensor. Specifically, in order to synchronize the timing at which the pair of sheet holding rollers 31 conveys the sheet P to the transfer roller 7 and the timing at which the toner image formed on the surface of the photoconductor drum 5 reaches the transfer roller 7, the speed of conveyance of the sheet P conveyed by the pair of sheet holding rollers 31 is varied, that is, the timing to convey the sheet P toward the image forming area is adjusted. By so doing, the pair of sheet holding rollers 31 can perform the correction of lateral displacement of the sheet P in the primary correction and the correction of angular displacement and lateral displacement of the sheet P in the secondary correction without stopping the conveyance of the sheet P by the pair of sheet holding rollers 31 after the angular displacement of the sheet P is performed in the primary correction, and then transfer the toner image onto the sheet P at a desired position.

It is to be noted that, immediately after the leading end of the sheet P has reached the image forming area, the speed of conveyance of the sheet P conveyed by the pair of sheet holding rollers 31 is adjusted, so as not to cause a linear velocity difference with the photoconductor drum 5 to result in distortion of the toner image to be transferred onto the sheet P, in other words, so as to cause the linear velocity difference with the photoconductor drum 5 to be 1.

The first CIS 36 functions as a first detector to detect the position of the sheet P that is conveyed in the sheet conveyance passage in the sheet conveying direction.

As illustrated in FIG. 3, the first CIS 36 that functions as a first detector is disposed upstream from the pair of sheet holding rollers 31 and downstream from the fourth pair of sheet conveying rollers 44 in the sheet conveyance passage in the sheet conveying direction. Specifically, the first CIS 36 includes multiple photosensors (i.e., light emitting elements such as LEDs and light receiving elements such as photodiodes) disposed equally spaced apart in the width direction of the sheet P. The CIS 36 detects a lateral displacement of the sheet P in the width direction by detecting a position of a side edge Pa at one end in the width direction of the sheet P. That is, the first CIS 36 that functions as a first detector is provided to detect the positional deviation in the width direction of the sheet P that is conveyed in the sheet conveyance passage in the sheet conveying device 30. Then, the pair of sheet holding rollers 31 performs the correction of lateral displacement of the sheet P in the primary correction based on the detection results obtained by the first CIS 36. Specifically, after the correction of angular displacement in the primary correction is performed by the contact of the sheet P to the pair of sheet holding rollers 31, the first CIS 36 detects the lateral displacement amount $\alpha$ of the sheet P. Then, based on the detection result of the first CIS 36, the pair of sheet holding rollers 31 corrects the lateral displacement in the primary correction.

It is to be noted that, in Embodiment 1, as illustrated in FIG. 3, the first CIS 36 is disposed at one end side in the width direction of the sheet P to detect the position of the side edge Pa on one end side in the width direction of the sheet P. However, the configuration is not limited thereto. For example, the first CIS 36 may be disposed extending over the whole width thereof to detect respective positions at both ends in the width direction of the sheet P.

Then, based on the detection result of the first CIS 36 (the first detector), the pair of sheet holding rollers 31 (together with the holding member 72) moves in the width direction of the sheet P while holding and conveying the sheet P, so that the positional deviation in the width direction (i.e., the lateral displacement) of the sheet P being conveyed in the sheet conveyance passage is corrected.

For example, with reference to FIG. 3, the sheet P is moved toward one end in the width direction (toward a lower side in FIG. 3) by a distance (alpha) relative to a normal position (that is, a position of the sheet without any displacement in the width direction) indicated by a dotted line. When the CIS 36 detects this state of the sheet P, the controller 160 determines the distance (alpha), in other words, the amount of lateral displacement, as a correction amount, and causes the pair of sheet holding rollers 31 (together with the holding member 72) to move by the distance (alpha) toward an opposite side in the width direction (toward an upper side in FIG. 3) while the pair of sheet holding rollers 31 is holding the sheet P (i.e., the shift control is performed).

Accordingly, in Embodiment 1, after the sheet P contacts the nip region of the pair of sheet holding rollers 31 that functions as a gate to perform the correction of angular displacement, the amount of lateral displacement of the sheet P is detected. Therefore, the amount of lateral displacement of the sheet P is detected by the first CIS 36 alone to detect the side edge Pa of the sheet P, with relatively high accuracy, without providing multiple sensors in the sheet conveyance passage extending between the fourth pair of sheet conveying rollers 44 and the pair of sheet holding rollers 31.

The second CIS 37 functions as a second detector to detect the position of the sheet P that is conveyed in the sheet conveyance passage in the sheet conveying direction.

As illustrated in FIG. 3, the second CIS 37 is disposed downstream from the pair of sheet holding rollers 31 in the sheet conveying direction (i.e., the downstream side of the sheet conveyance passage) and upstream from the transfer roller 7 that functions as a downstream side sheet conveying roller in the sheet conveying direction (i.e., the upstream side of the sheet conveyance passage). Similar to the first CIS 36, the second CIS 37 includes multiple photosensors (i.e., light emitting elements such as LEDs and light receiving elements such as photodiodes) disposed equally spaced apart in the width direction of the sheet P. The second CIS 37 detects a position of the side edge Pa (the edge portion) on one end in the width direction of the sheet P.

Accordingly, in Embodiment 1, the first CIS 36 and the second CIS 37 function as detectors to perform the secondary correction (the recorrection) of the sheet P. That is, the amount of lateral displacement of the sheet P and the amount of the angular displacement of the sheet P are detected based on the detection result of the first CIS 36, the detection result of the second CIS 37, respectively.

Figure 7:
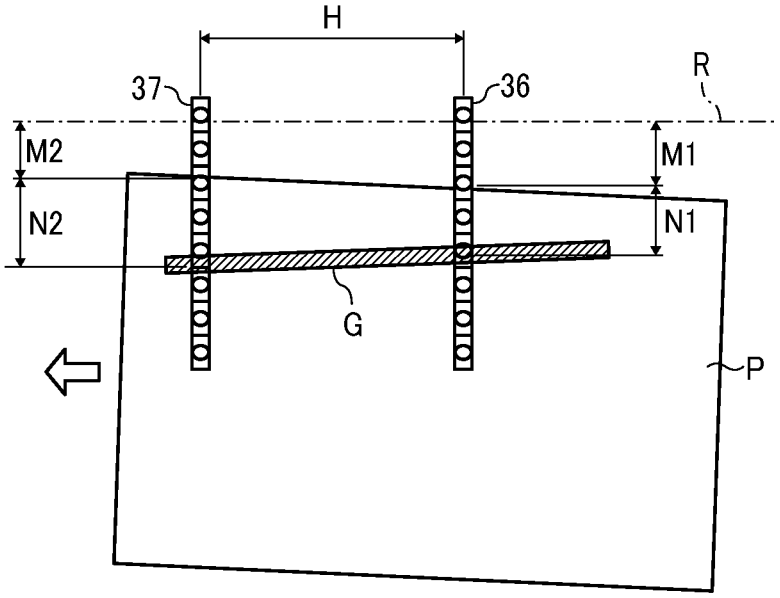
FIG. 7 is a diagram illustrating two CISs and a sheet having positional deviations in a width direction of the sheet and a rotational direction of the sheet.

Specifically, referring to FIG. 7, in the secondary correction, the positional deviation in the width direction (the lateral displacement amount) of the sheet P is detected based on the lateral displacement amount M1 of the sheet P detected by the first CIS 36, the lateral displacement amount M2 of the sheet P detected by the second CIS 37 and the mean value of the lateral displacement amount M1 and the lateral displacement amount M2, that is, a mean value ((M1+M2)/2). The correction amount of the above-described mean value ((M1+M2)/2) is represented as a correction amount $\alpha$. Then, in order to cancel out the correction amount $\alpha$, the pair of sheet holding rollers 31 (together with the holding member 72) is moved in the opposite direction while the pair of sheet holding rollers 31 is holding the sheet P, that is, the shift control is performed.

Further, in the secondary correction, the angular displacement amount of the sheet P is obtained based on a value ((M2−M2)/H), which is obtained by dividing the difference (M2−M1), i.e., the difference of the lateral displacement amount M1 of the sheet P obtained by the first CIS 36 and the lateral displacement amount M2 of the sheet P obtained by the second CIS 37, by a separation distance H of the first CIS 36 and the second CIS 37 in the sheet conveying direction. The correction amount (angle) β to be corrected is obtained with the value ((M2−M2)/H) as tan β. Then, in order to cancel out the correction amount (angle) β, the pair of sheet holding rollers 31 (together with the holding member 72) is moved in the opposite direction while the pair of sheet holding rollers 31 is holding the sheet P, that is, the rotational control is performed.

It is to be noted that both the lateral displacement amount M1 of the sheet P obtained by the first CIS 36 and the lateral displacement amount M2 of the sheet P are respective amounts of lateral displacement of the sheet P from a normal position R indicated with a dotted line (i.e., a position without no lateral displacement of the sheet P).

In Embodiment 1, when the first CIS 36 and the second CIS 37 function as detectors in the secondary correction, as described above, the amount of lateral displacement of the sheet P and the amount of angular displacement of the sheet P are further corrected with the feedback control based on the detection results that are obtained consecutively by the first CIS 36 and the second CIS 37. That is, both the position information of the sheet P obtained by the first CIS 36 and the position information of the sheet P obtained by the second CIS 37 are continuously detected in the secondary correction. Then, based on the position information of the sheet P by the first CIS 36 and the second CIS 37, the amount of lateral displacement of the sheet P and the amount of angular displacement of the sheet P are calculated to be fed back to the controller 160. Accordingly, the correction amount of lateral displacement of the sheet P and the correction amount of angular displacement of the sheet P are updated consecutively.

By performing the feedback control as described above, the positional deviation (i.e., the lateral displacement and the angular displacement) of the sheet P that may occur in the secondary correction and the correction error in the secondary correction can be modified with good responsiveness, and therefore the correction of lateral displacement and angular displacement can be performed with higher accuracy.

Now, a detailed description is given of the secondary correction.

In a calculator (the controller 160), the lateral displacement amount (alpha) is calculated based on the detection results obtained by the two CISs (i.e., the first CIS 36 and the second CIS 37), and then the number of counts p of the third drive motor encoder 67 (i.e., a shift motor encoder) of the third drive motor 63 (i.e., a shift motor) is calculated based on the lateral displacement amount (alpha). Then, the number of counts p is stored as "the number of counts p of a target sheet conveying encoder" of the third drive motor 63 (i.e., a shift motor). Then, while detecting the shift position (a position in the width direction) by the third drive motor encoder 67 (i.e., a shift motor encoder), the third drive motor driver 66 is controlled by the third drive motor control unit 163 (i.e., a shift controller) based on "the number of counts p of a target sheet conveying encoder" to drive the third drive motor 63 (i.e., a shift motor).

Further, in the calculator (the controller 160), the angular displacement amount (beta) is calculated based on the detection results obtained by the two CISs (i.e., the first CIS 36 and the second CIS 37), and then the number of counts q of the second drive motor encoder 65 (i.e., a rotation motor encoder) of the second drive motor 62 (i.e., a rotation motor) is calculated based on the angular displacement amount (beta). Then, the number of counts q is stored as "the number of counts q of a target sheet conveying encoder" of the second drive motor 62 (i.e., a rotation motor). Then, while detecting the rotation position (a position in the rotation direction) by the second drive motor encoder 65 (i.e., a rotation motor encoder), the second drive motor driver 64 is controlled by the second drive motor control unit 162 (i.e., a rotation controller) based on "the number of counts q of a target sheet conveying encoder" to drive the second drive motor 62 (i.e., a rotation motor).

It is to be noted that, for calculation of "the number of counts of a target sheet conveying encoder", a correction amount (a conveying amount) per count (pulse) is previously obtained by calculating with the set value and stored in the calculator.

As described above, the angular displacement of the sheet P is firstly corrected by contacting the sheet P to the pair of sheet holding rollers 31, and then the lateral displacement of the sheet P is corrected while the pair of sheet holding rollers 31 is holding and conveying the sheet P. Thereafter, the lateral displacement of the sheet P and the angular displacement of the sheet P are corrected again while the pair of sheet holding rollers 31 is holding and conveying the sheet P based on the detection results of the two CISs, which are the first CIS 36 and the second CIS 37. The reasons for performing the above-described corrections are that the angular displacement and the lateral displacement may occur to the sheet P due to eccentricity of the roller or rollers of the pair of sheet holding rollers 31 or failure in assembly.

By contrast, in Embodiment 1, after the lateral displacement and the angular displacement of the sheet P are firstly corrected by the pair of sheet holding rollers 31, the lateral displacement amount of the sheet P and the angular displacement amount of the sheet P are detected by the first CIS 36 and the second CIS 37 while the pair of sheet holding rollers 31 is holding and conveying the sheet P. Then, based on the detection results obtained by the first CIS 36 and the second CIS 37, the lateral displacement and the angular displacement of the sheet P are corrected again while the pair of sheet holding rollers 31 is holding and conveying the sheet P. Accordingly, the chance of occurrence of the above-described inconvenience is limited, and the lateral displacement and the angular displacement of the sheet P can be corrected with higher accuracy.

Further, the sheet conveying device 30 according to Embodiment 1 includes a sensor (i.e., the first CIS 36) between the fourth pair of sheet conveying rollers 44 and the pair of sheet holding rollers 31 and another sensor (i.e., the second CIS 37) between the pair of sheet holding rollers 31 and the transfer roller 7 to perform the correction two times, which is the primary correction and the secondary correction. Therefore, the lateral displacement and the angular displacement of the sheet P can be corrected with high accuracy without extending the sheet conveyance passage. That is, the correction of lateral displacement and angular displacement can be performed with high accuracy without increasing the size of the image forming apparatus 1.

Now, a description is given of an example of operations of the sheet conveying device 30 having the above-described configuration, with reference to FIGS. 5A through 6F.

It is to be noted that FIGS. 5A, 5C, 5E, 5G, 6A, 6C and 6E are top views illustrating operations of the sheet conveying device 30 in this order and that FIGS. 5B, 5D, 5F, 5H, 6B, 6D and 6F are side views illustrating the operations of the sheet conveying device 30 corresponding to FIGS. 5A, 5C, 5E, 5G, 6A, 6C and 6E, respectively.

Figure 5A:
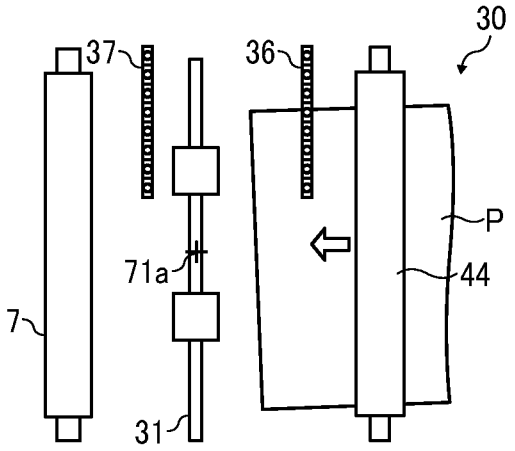
FIGS. 5A, 5B, 5C, 5D, 5E, 5F, 5G and 5H are schematic diagrams illustrating operations performed by the sheet conveying device.
Figure 5B:
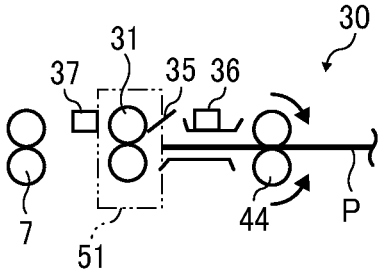

First, as illustrated in FIGS. 5A and 5B, the sheet P fed from the first sheet feeding unit 12 is held and conveyed by the fourth pair of sheet conveying rollers 44 toward the pair of sheet holding rollers 31 in a direction indicated by white arrow. At this time, the position of the pair of sheet holding rollers 31 in the rotation direction is located in a first reference position, which is a normal position corresponding to the sheet P that has no angular displacement, and the position thereof in the width direction is located in a second reference position, which is a normal position corresponding to the sheet P that has no lateral positional deviation (no lateral displacement). Further, the pair of sheet holding rollers 31 is in a rotation stop state.

Figure 5C:
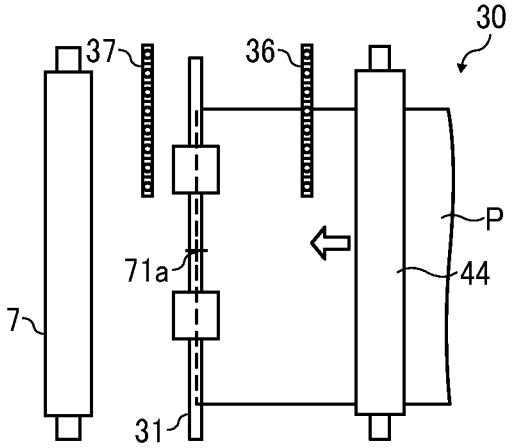
Figure 5D:
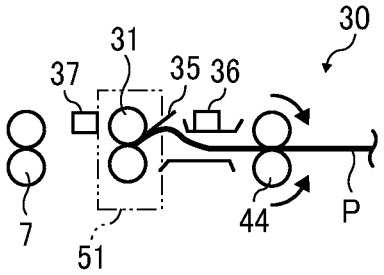

Then, as illustrated in FIGS. 5C and 5D, upon arrival of the leading end of the sheet P to the nip region of the pair of sheet holding rollers 31 (i.e., a gate) that is in the rotation stop state, the pair of sheet conveying rollers 44 holds and conveys the sheet P for a relatively short time after the contact. By so doing, the sheet P curves along the sloped conveying guide plate 35 and the leading end of the curved sheet P contacts the nip region of the pair of sheet holding rollers 31 over the entire width direction of the sheet P. Accordingly, a first angular displacement correction is performed.

It is to be noted that the calculator (the controller 160) can obtain a time at which the leading end of the sheet P contacts the pair of sheet holding rollers 31 based on a time at which the first CIS 36 detects the leading end of the sheet P, a conveying speed of the sheet P and a distance from the position of the first CIS 36 to the position of the pair of sheet holding rollers 31.

Figure 5E:
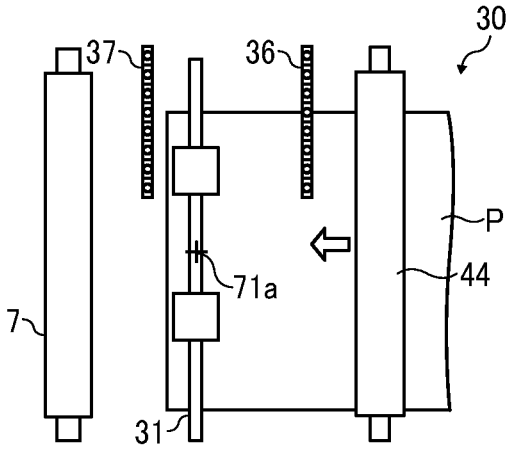
Figure 5F:
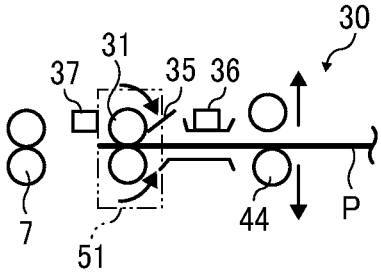

Then, as illustrated in FIGS. 5E and 5F, the pair of sheet holding rollers 31 starts to rotate (in a direction indicated by arrow in FIG. 5E). Consequently, as the sheet P is held and conveyed by the pair of sheet holding rollers 31, the fourth pair of sheet conveying rollers 44 opens the sheet conveyance passage and moves to a direction indicated by arrow in FIG. 5F in which the fourth pair of sheet conveying rollers 44 does not hold the sheet P. Then, the first CIS 36 detects the lateral displacement amount $\alpha$ of the sheet P while the pair of sheet holding rollers 31 is holding and conveying the sheet P.

Figure 5G:
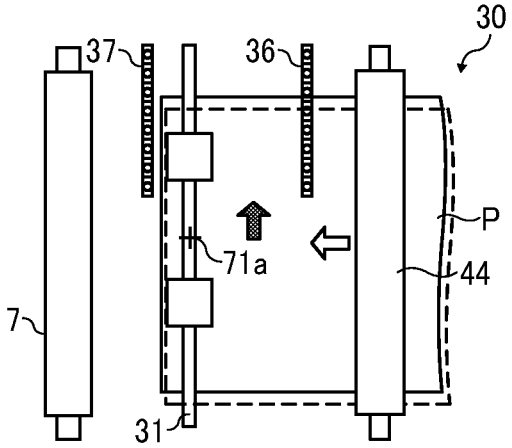
Figure 5H:
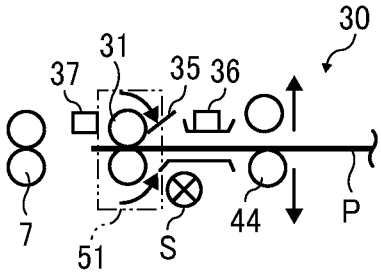

Then, as illustrated in FIGS. 5G and 5H, while holding and conveying the sheet P, the pair of sheet holding rollers 31 moves in the width direction (in a direction indicated by black arrow) from the second reference position by a distance $\alpha$ in a direction to cancel out the lateral displacement amount $\alpha$ of the sheet P that is detected by the first CIS 36.

Figure 6A:
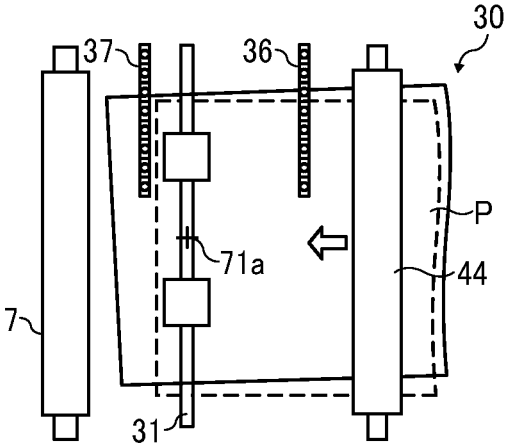
FIGS. 6A, 6B, 6C, 6D, 6E and 6F are diagrams illustrating operations of the sheet conveying device, subsequent from the operations of FIGS. 5A through 5H.
Figure 6B:
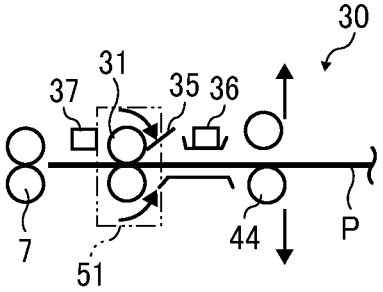

Then, as illustrated in FIGS. 6A and 6B, when the sheet P after correction reaches the position of the second CIS 37, the first CIS 36 and the second CIS 37 continuously detect the lateral displacement amount $\alpha$ and the angular displacement amount $\beta$ of the sheet P that is being held and conveyed by the pair of sheet holding rollers 31.

Figure 6C:
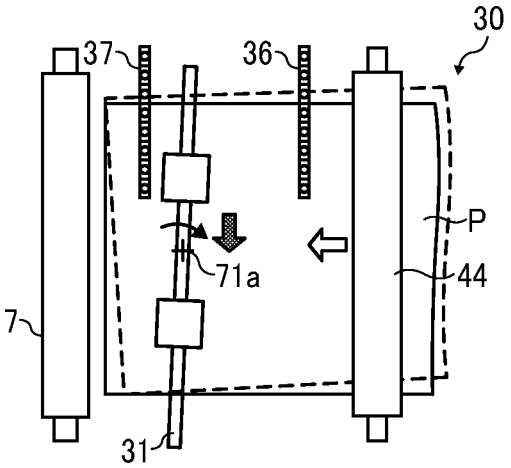
Figure 6D:
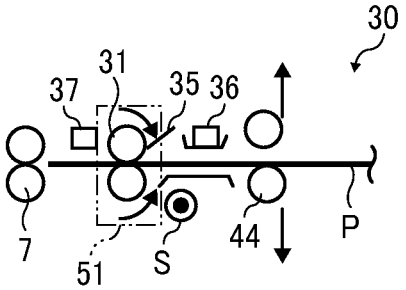

Then, as illustrated in FIGS. 6C and 6D, while holding and conveying the sheet P, the pair of sheet holding rollers 31 moves together with the holding member 72 in the width direction (indicated by black arrow in FIG. 6D) from the corrected position of FIG. 6A by the distance $\alpha$ in a direction to cancel out the lateral displacement amount $\alpha$ detected by the first CIS 36 and the second CIS 37. Further, at a substantially same time, the pair of sheet holding rollers 31 moves while holding and conveying the sheet P, together with the holding member 72 in the rotation direction (indicated by black arrow in FIG. 6D) from the first reference position of FIG. 6A by the angle $\beta$ about the shaft 71*a* in a direction to cancel out the angular displacement amount $\beta$ detected by the first CIS 36 and the second CIS 37.

Thus, the sheet P is conveyed toward the transfer roller 7 in the image forming area while the lateral displacement correction and the angular displacement correction are being performed again. At this time, the number of rotations of the pair of sheet holding rollers 31 (the speed of conveyance of the sheet P until the sheet P arrives the transfer roller 7) is varied so as to synchronize (at a synchronized time) with movement of the toner image formed on the surface of the photoconductor drum 5.

Figure 6E:
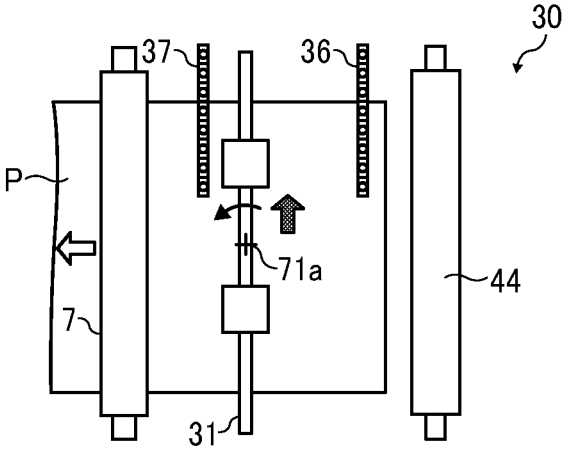
Figure 6F:
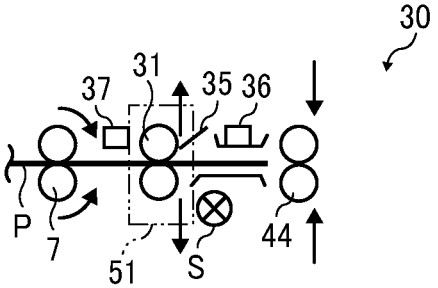

Then, as illustrated in FIGS. 6E and 6F, the sheet P is conveyed toward the transfer roller 7 (the image forming area) and the toner image is transferred onto the sheet P at a desired position. At this time, as the sheet P is conveyed by the transfer roller 7, the pair of sheet holding rollers 31 opens the sheet conveyance passage and moves to a direction indicated by arrow in FIG. 6F in which the pair of sheet holding rollers 31 does not hold the sheet P. Then, the pair of sheet holding rollers 31 is returned to the first reference position and the second reference position for preparation of the angular displacement correction and the lateral displacement correction of a subsequent sheet P. Further, the fourth pair of sheet conveying rollers 44 in a roller separated state is returned to a roller contact state for preparation of conveyance of the subsequent sheet P. Thereafter, when the trailing end of the sheet P passes the pair of sheet holding rollers 31, the pair of sheet holding rollers 31 closes the sheet conveyance passage and the rollers of the pair of sheet holding rollers 31 move to contact with each other in a direction to hold the sheet P. Accordingly, the pair of sheet holding rollers 31 returns to the state as illustrated in FIGS. 5A and 5B for preparation of the angular displacement correction of the subsequent sheet P.

By repeating the above-described operations, a series of operations performed by the sheet conveying device 30 completes.

In the sheet conveying device 30 according to Embodiment 1, in a case in which the duplex printing mode described above is selected, when an image is to be formed on a back of the sheet P after a pattern image G, which is a solid image with stripes extending in the sheet conveying direction as illustrated in FIG. 7, is printed on a front of the sheet P, the first CIS 36 and the second CIS 37 detect the pattern image G. By so doing, the lateral displacement amount and the angular displacement amount of the image to be formed on the sheet P can be detected.

However, in this case, when an image is to be formed on the back of the sheet P, the first CIS 36 and the second CIS 37 are to face the pattern image G formed on the front of the sheet P. Therefore, the first CIS 36 and the second CIS 37 are to be disposed to face the back of the sheet P, which is different from the configuration of Embodiment 1 where the first CIS 36 and the second CIS 37 are disposed to face the front of the sheet P.

To be more specific, as illustrated in FIG. 7, the first CIS 36 detects for a distance N1 of an area from the side end of the sheet P to the pattern image G, and then the second CIS 37 detects for a distance N2 of an area from the side end of the sheet P to the pattern image G. Consequently, a mean value ((N1+N2)/2) of the distance N1 and the distance N2 is obtained as a lateral displacement amount of the image to be formed on the sheet P. The above-described mean value ((N1+N2)/2) is represented as a correction amount. Then, in order to cancel out the correction amount, the pair of sheet holding rollers 31 (together with the holding member 72) is moved in the opposite direction while the pair of sheet holding rollers 31 is holding the sheet P. According to this operation, the position of the pattern image G in the width direction on the front of the sheet P can be matched with the position of the image in the width direction on the back of the sheet P.

Further, in a case in which the image formed on the surface of the photoconductor drum 5 has a positional deviation in the width direction of the sheet P, a value ((M1+M2)+(N1+N2)) is represented as a correction amount. Then, in order to cancel out the correction amount, the pair of sheet holding rollers 31 (together with the holding member 72) is moved in the opposite direction while the pair of sheet holding rollers 31 is holding the sheet P, thereby matching the position of the pattern image G in the width direction on the front of the sheet P with the position of the image in the width direction on the back of the sheet P.

Further, an angular displacement amount of the image to be formed on the sheet P is obtained based on a value ((N2−N1)/H), which is obtained by dividing the difference (N2−N1), i.e., the difference of the distance N1 obtained by the first CIS 36 and the distance N2 obtained by the second CIS 37, by the separation distance H of the first CIS 36 and the second CIS 37 in the sheet conveying direction. The correction amount (angle) γ to be corrected is obtained with the value ((N2−N2)/H) as tan γ. Then, in order to cancel out the correction amount (angle) γ, the pair of sheet holding rollers 31 (together with the holding member 72) is moved in the opposite direction while the pair of sheet holding rollers 31 is holding and conveying the sheet P. According to this operation, the position of the pattern image G in the rotation direction on the front of the sheet P can be matched with the position of the image in the rotation direction on the back of the sheet P.

Further, in a case in which the image formed on the surface of the photoconductor drum 5 has a positional deviation in the rotation direction of the sheet P, a value (β+2γ) is represented as a correction angle. Then, in order to cancel out the correction angle, the pair of sheet holding rollers 31 (together with the holding member 72) is moved in the opposite direction while the pair of sheet holding rollers 31 is holding and conveying the sheet P, thereby matching the position of the pattern image G in the rotation direction on the front of the sheet P with the position of the image in the rotation direction on the back of the sheet P.

As described above, in the sheet conveying device 30 according to Embodiment 1, when the sheet P is conveyed toward the pair of sheet holding rollers 31 that functions as a gate in the rotation stop state, the leading end of the sheet P contacts the pair of sheet holding rollers 31 to correct the angular displacement amount of the sheet P. Then, based on the detection result of the first CIS 36 that functions as a first detector, the pair of sheet holding rollers 31 is moved in the width direction while holding the sheet P to correct the lateral displacement amount of the sheet P. Then, after the pair of sheet holding rollers 31 has corrected the angular displacement amount and the lateral displacement amount of the sheet P, the first CIS 36 that functions as a first detector and the second CIS 37 that functions as a second detector detect a subsequent lateral displacement amount and a subsequent angular displacement amount of the sheet P that occur after the above-described correction of the sheet P. Based on the detection results of the first CIS 36 and the second CIS 37, the pair of sheet holding rollers 31 is moved in the width direction and the rotation direction of the sheet P so that the subsequent lateral displacement amount and the subsequent angular displacement amount of the sheet P are corrected.

According to these operations, the sheet P after the corrections of angular and lateral displacements does not move again in the rotation direction and the width direction and the corrections of angular and lateral displacements of the sheet P can be performed with higher accuracy.

Embodiment 2

A description is given of a configuration and functions of the sheet conveying device 30 according to Embodiment 2 of this disclosure, with reference to FIGS. 8A through 10F.

Figure 8A:
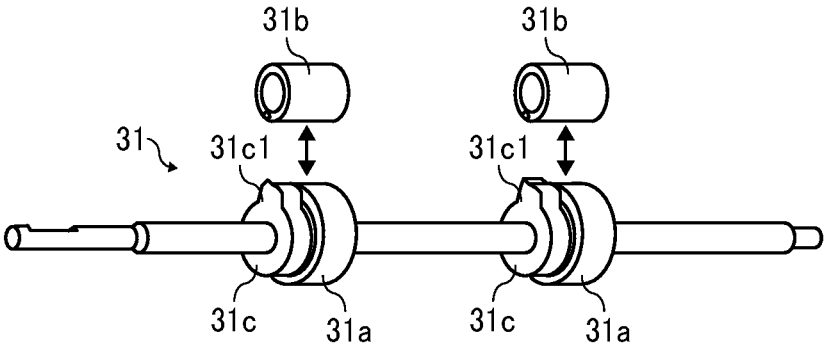
FIG. 8A is a perspective view illustrating a pair of sheet holding rollers provided to the sheet conveying device according to Embodiment 2 of this disclosure.
Figure 8B:
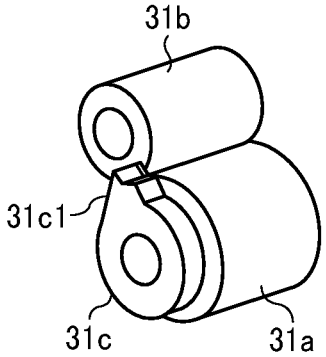
FIG. 8B is an enlarged perspective view illustrating rollers of the pair of sheet holding rollers.

FIG. 8A is a perspective view illustrating the pair of sheet holding rollers 31 provided to the sheet conveying device 30 according to Embodiment 2 of this disclosure. In FIG. 8A, the respective driven rollers 31*b* are separated from the corresponding drive rollers 31*a*. FIG. 8B is an enlarged perspective view illustrating the rollers of the pair of sheet holding rollers 31. In FIG. 8B, the driven roller 31*b* is in contact with the drive roller 31*a*. FIGS. 9A, 9B, 9C, 9D, 9E, 9F, 9G and 9H are diagrams illustrating operations of the sheet conveying device 30 having the pair of sheet holding rollers 31 of FIGS. 8A and 8B, according to Embodiment 2. FIGS. 10A, 10B, 10C, 10D, 10E and 10F are diagrams illustrating operations of the sheet conveying device 30, subsequent from the operations of FIGS. 9A through 9H, according to Embodiment 2. FIGS. 9A through 10F are views corresponding to FIGS. 5A through 6F of Embodiment 1.

The configuration and functions of the sheet conveying device 30 illustrated in FIGS. 9A through 10F is basically identical to the configuration and functions of the sheet conveying device 30 illustrated in FIGS. 5A through 6F of Embodiment 1, except that the pair of sheet holding rollers 31 according to Embodiment 2 includes a projection 31*c* that functions as a gate.

As illustrated in FIGS. 8A and 8B, the sheet conveying device 30 according to Embodiment 2 includes the projection 31*c* attached to the drive roller 31*a* of the pair of sheet holding rollers 31. While the rotation of the pair of sheet holding rollers 31 performed by the first drive motor 61 (the drive device) is being stopped (in the rotation stop state), the leading end of the sheet P that is conveyed toward the pair of sheet holding rollers 31 contacts the projection 31*c* that is rotated together with the drive roller 31*a*. By so doing, an angular displacement amount of the sheet p is corrected. That is, in Embodiment 2, the projection 31*c* attached to the drive roller 31*a* of the pair of sheet holding rollers 31 functions as a gate to which the leading end of the sheet P being conveyed in the sheet conveyance passage contacts.

In addition, in Embodiment 2, the leading end of the sheet P contacts the projection 31*c* that functions as a gate first. Then, based on the detection result of the first CIS 36 that functions as a first detector, the pair of sheet holding rollers 31 is moved in the width direction while holding the sheet P, so as to perform the "primary correction" to correct the position of the sheet P. Then, after the primary correction, the first CIS 36 that functions as a first detector and the second CIS 37 that functions as a second detector detect the position of the sheet P while the sheet P is being held and conveyed by the pair of sheet holding rollers 31. Based on the detection results of the first CIS 36 and the second CIS 37, the pair of sheet holding rollers 31 is moved in the width direction and the rotation direction of the sheet P so as to perform the "secondary correction" to correct the position of the sheet P.

To be more specific, the projection 31*c* that functions as a gate is attached to an end face of the roller part of the drive roller 31*a* in a manner of close contact. The projection 31*c* includes a protruding portion 31*c*1 on an outer circumferential surface thereof. The protruding portion 31*c*1 protrudes outwardly in a direction that a diameter thereof is greater than the diameter of the outer circumferential surface of the roller part of the drive roller 31*a*. When the sheet P is conveyed toward the pair of sheet holding rollers 31 in the rotation stop state, the protruding portion 31*c*1 is rotated to a rotation position as illustrated in FIG. 8B to contact the leading end of the sheet P and correct the angular displacement of the sheet P.

As illustrated in FIGS. 8A and 8B, (the protruding portion 31*c*1 of) the projection 31*c* has a structure and function that do not interfere rotation of the drive roller 31*a* and do not prevent rotation of the driven roller 31*b* and a contact and separation operation of the drive roller 31*a* and the driven roller 31*b*.

It is to be noted that, different from Embodiment 1, the pair of sheet holding rollers 31 according to Embodiment 2 has the drive roller 31*a* disposed at the lower part and the driven roller 31*b* disposed at the upper part, which is above the drive roller 31*a*.

Now, a description is given of an example of operations of the sheet conveying device 30 according to Embodiment 2.

It is to be noted that FIGS. 9A, 9C, 9E, 9G, 10A, 10C and 10E are top views illustrating operations of the sheet conveying device 30 in this order and that FIGS. 9B, 9D, 9F, 9H, 10B, 10D and 10F are side views illustrating the operations of the sheet conveying device 30 corresponding to FIGS. 9A, 9C, 9E, 9G, 10A, 10C and 10E, respectively.

Figure 9A:
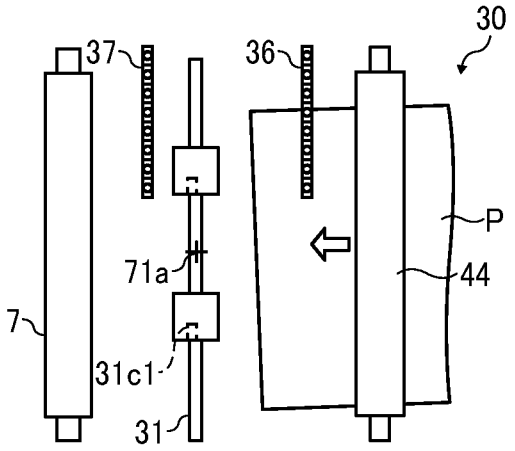
FIGS. 9A, 9B, 9C, 9D, 9E, 9F, 9G and 9H are diagrams illustrating operations of the sheet conveying device having the pair of sheet holding rollers of FIGS. 8A and 8B; p
Figure 9B:
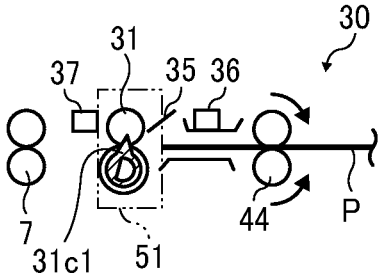

First, as illustrated in FIGS. 9A and 9B, the sheet P fed from the first sheet feeding unit 12 is held and conveyed by the fourth pair of sheet conveying rollers 44 toward the pair of sheet holding rollers 31 in a direction indicated by white arrow. At this time, the position of the pair of sheet holding rollers 31 in the rotation direction is located in a first reference position and the position of the pair of sheet holding rollers 31 in the width direction is located in the second reference position. Further, the pair of sheet holding rollers 31 is in the rotation stop state and is located at a rotation position at which the protruding portion 31*c*1 of the projection 31*c* closes the sheet conveyance passage in the vicinity of the nip region of the pair of sheet holding rollers 31.

Figure 9C:
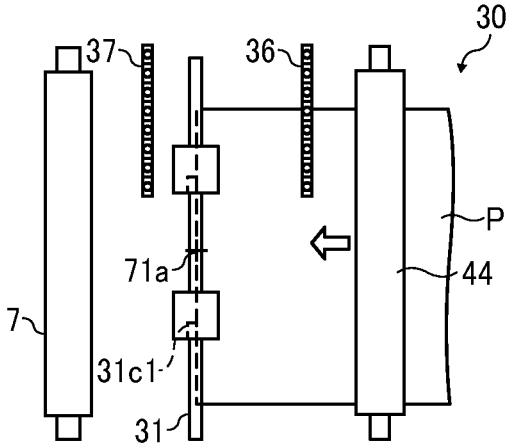
Figure 9D:
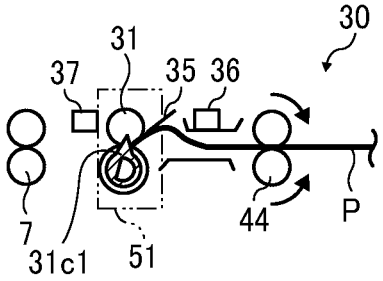

Then, as illustrated in FIGS. 9C and 9D, when the leading end of the sheet P contacts the protruding portion 31*c*1 of the projection 31*c* (i.e., a gate) of the pair of sheet holding rollers 31 in the rotation stop state, the pair of sheet conveying rollers 44 holds and conveys the sheet P for a relatively short time after the contact. By so doing, the sheet P curves along the sloped conveying guide plate 35 and the leading end of the curved sheet P contacts the nip region of the pair of sheet holding rollers 31 over the entire width direction of the sheet P. Accordingly, the first angular displacement correction is performed.

Figure 9E:
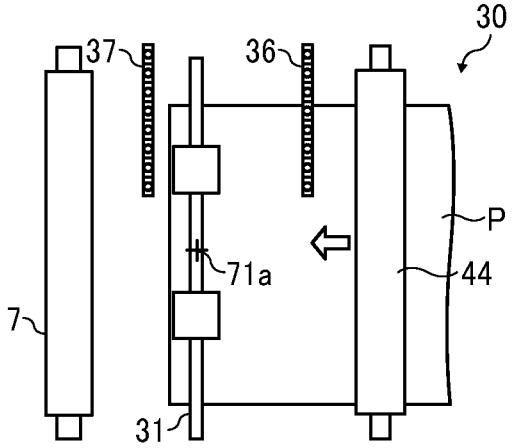
Figure 9F:
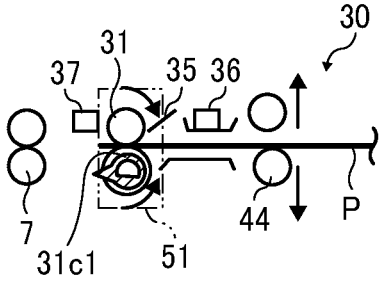

Then, as illustrated in FIGS. 9E and 9F, the pair of sheet holding rollers 31 starts to rotate (in a direction indicated by arrow in FIG. 9E). Consequently, as the sheet P is held and conveyed by the pair of sheet holding rollers 31, the fourth pair of sheet conveying rollers 44 opens the sheet conveyance passage and moves to a direction indicated by arrow in FIG. 9F in which the fourth pair of sheet conveying rollers 44 does not hold the sheet P. At this time, the projection 31*c* is rotated together with rotation of (the drive roller 31*a* of) the pair of sheet holding rollers 31 to be brought to the rotation position at which the protruding portion 31*c*1 closes the sheet conveyance passage. Then, the first CIS 36 detects the lateral displacement amount α of the sheet P while the pair of sheet holding rollers 31 is holding and conveying the sheet P.

Figure 9G:
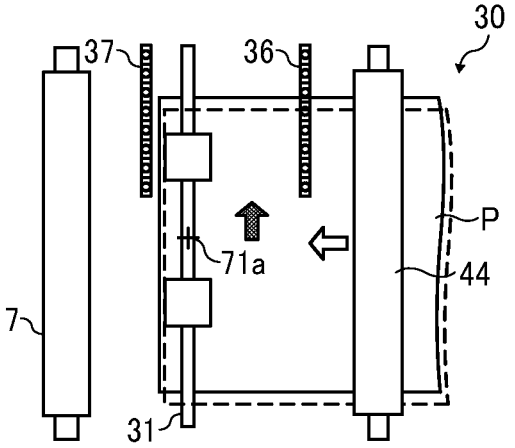
Figure 9H:
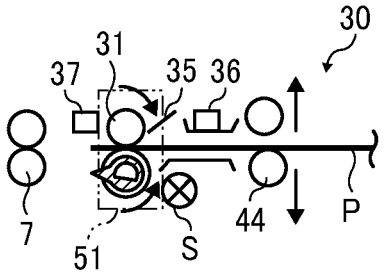

Then, as illustrated in FIGS. 9G and 9H, while holding and conveying the sheet P, the pair of sheet holding rollers 31 moves in the width direction (in a direction indicated by black arrow) from the second reference position by a distance α in a direction to cancel out the lateral displacement amount α of the sheet P that is detected by the first CIS 36.

Figure 10A:
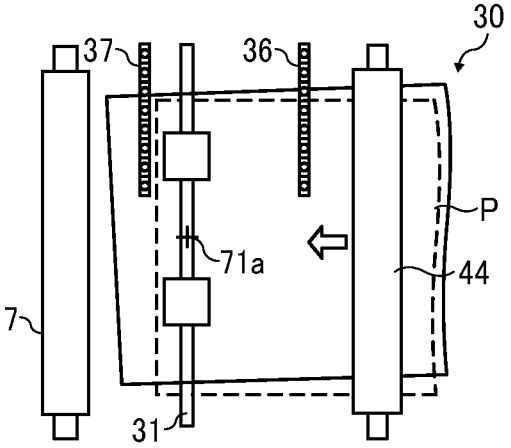
FIGS. 10A, 10B, 10C, 10D, 10E and 10F are diagrams illustrating operations of the sheet conveying device, subsequent from the operations of FIGS. 9A through 9H.
Figure 10B:
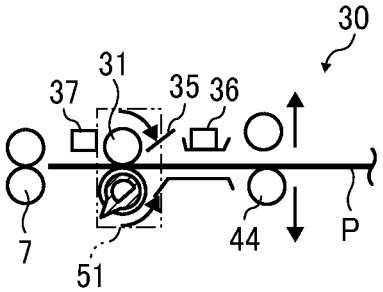

Then, as illustrated in FIGS. 10A and 10B, when the sheet P after the above-described correction reaches the position of the second CIS 37, the first CIS 36 and the second CIS 37 continuously detect the lateral displacement amount α and the angular displacement amount β of the sheet P that is being held and conveyed by the pair of sheet holding rollers 31.

Figure 10C:
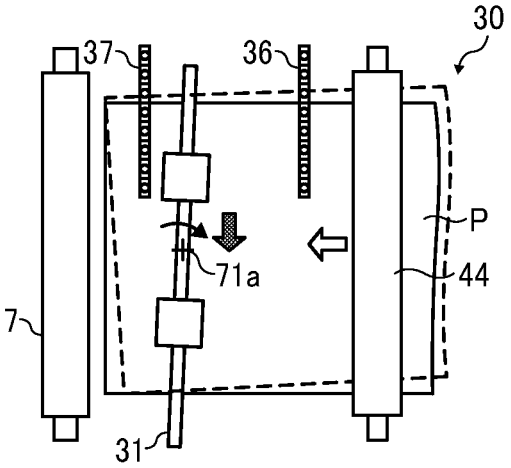
Figure 10D:
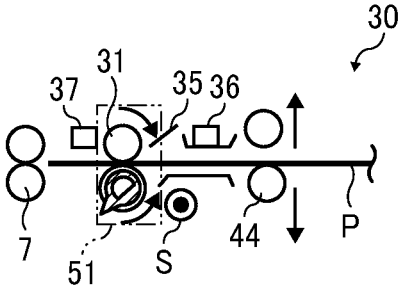

Then, as illustrated in FIGS. 10C and 10D, while holding and conveying the sheet P, the pair of sheet holding rollers 31 moves together with the holding member 72 in the width direction (indicated by black arrow in FIG. 10D) from the corrected position of FIG. 10A by the distance α in a direction to cancel out the lateral displacement amount α detected by the first CIS 36 and the second CIS 37. Further, at a substantially same time, the pair of sheet holding rollers 31 moves while holding and conveying the sheet P, together with the holding member 72 in the rotation direction (indicated by black arrow in FIG. 6D) from the first reference position of FIG. 10A by the angle β about the shaft 71*a* in a direction to cancel out the angular displacement amount β detected by the first CIS 36 and the second CIS 37.

Thus, the sheet P is conveyed toward the transfer roller 7 in the image forming area while the lateral displacement correction and the angular displacement correction are being performed again. At this time, the number of rotations of the pair of sheet holding rollers 31 (the speed of conveyance of the sheet P until the sheet P arrives the transfer roller 7) is varied so as to synchronize (at a synchronized time) with movement of the toner image formed on the surface of the photoconductor drum 5.

Figure 10E:
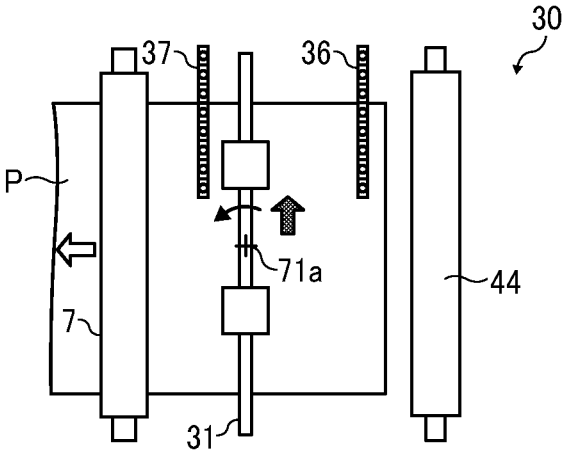
Figure 10F:
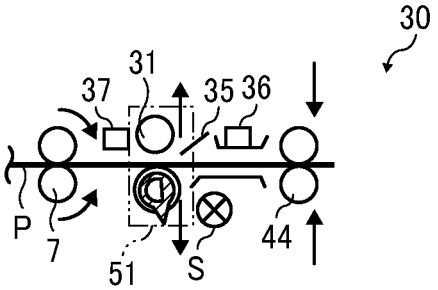

Then, as illustrated in FIGS. 10E and 10F, the sheet P is conveyed toward the transfer roller 7 (the image forming area) and the toner image is transferred onto the sheet P at a desired position. At this time, as the sheet P is conveyed by the transfer roller 7, the pair of sheet holding rollers 31 opens the sheet conveyance passage and moves to a direction indicated by arrow in FIG. 10F in which the pair of sheet holding rollers 31 does not hold the sheet P. Then, the pair of sheet holding rollers 31 is returned to the first reference position and the second reference position for preparation of the angular displacement correction and the lateral displacement correction of a subsequent sheet P. Further, the fourth pair of sheet conveying rollers 44 in the roller separated state is returned to the roller contact state for preparation of conveyance of the subsequent sheet P. Thereafter, when the trailing end of the sheet P passes the pair of sheet holding rollers 31, the pair of sheet holding rollers 31 closes the sheet conveyance passage and the rollers of the pair of sheet holding rollers 31 move to contact with each other in a direction to hold the sheet P. Accordingly, the pair of sheet holding rollers 31 returns to the state as illustrated in FIGS. 9A and 9B for preparation of the angular displacement correction of the subsequent sheet P. By repeating the above-described operations, a series of operations performed by the sheet conveying device 30 completes.

As described above, similar to the sheet conveying device 30 according to Embodiment 1, in the sheet conveying device 30 according to Embodiment 2, when the sheet P is conveyed toward the pair of sheet holding rollers 31 that functions as a gate in the rotation stop state where the rotation of the pair of sheet holding rollers 31 drive by the first drive motor 61 (a drive device) is stopped, the leading end of the sheet P contacts the projection 31*c* of the pair of sheet holding rollers 31 to correct the angular displacement amount of the sheet P. Then, based on the detection result of the first CIS 36 that functions as a first detector, the pair of sheet holding rollers 31 is moved in the width direction while holding the sheet P to correct the lateral displacement amount of the sheet P. Then, after the pair of sheet holding rollers 31 has corrected the angular displacement amount and the lateral displacement amount of the sheet P, the first CIS 36 that functions as a first detector and the second CIS 37 that functions as a second detector detect a subsequent lateral displacement amount and a subsequent angular displacement amount of the sheet P that occur after the above-described correction of the sheet P. Based on the detection results of the first CIS 36 and the second CIS 37, the pair of sheet holding rollers 31 is moved in the width direction and the rotation direction of the sheet P so that the subsequent lateral displacement amount and the subsequent angular displacement amount of the sheet P are corrected.

According to these operations, the sheet P after the corrections of angular displacement and lateral displacement does not move again in the rotation direction and the width direction and the corrections of angular displacement and lateral displacement of the sheet P can be performed with higher accuracy.

Embodiment 3

Next, a description is given of a configuration and functions of the sheet conveying device 30 and the image forming apparatus 1, according to Embodiment 3 of this disclosure, with reference to FIGS. 11A through 12F.

FIGS. 11A, 11B, 11C, 11D, 11E, 11F, 11G and 11H are diagrams illustrating operations of the sheet conveying device 30 having the pair of sheet holding rollers 31, according to Embodiment 3. FIGS. 12A, 12B, 12C, 12D, 12E and 12F are diagrams illustrating operations of the sheet conveying device 30, subsequent from the operations of FIGS. 11A through 12H, according to Embodiment 3. FIGS. 11A through 12F are views corresponding to FIGS. 5A through 6F of Embodiment 1.

The configuration and functions of the sheet conveying device 30 illustrated in FIGS. 11A through 12F is basically identical to the configuration and functions of the sheet conveying device 30 of Embodiment 1 and Embodiment 2. Except, the fourth pair of sheet conveying rollers 44 as the pair of upstream side sheet conveying rollers functions as a gate to which the sheet P contacts to correct the angular displacement of the sheet P while the leading end of the sheet P contacts the pair of sheet holding rollers 31 to correct the angular displacement in Embodiment 1 and 2.

The sheet conveying device 30 according to Embodiment 3 includes an individual drive motor to drive and rotate the drive roller of the fourth pair of sheet conveying rollers 44 that functions as the pair of upstream side sheet conveying rollers (i.e., a pair of sheet conveying rollers). With the individual drive motor, the start and stop of rotation of the fourth pair of sheet conveying rollers 44 can be switched individually and separate from the other pairs of sheet conveying rollers.

Further, as illustrated in FIGS. 11A through 12F, the sheet conveying device 30 according to Embodiment 3 includes a sloped conveying guide plate 38 that functions as a sheet conveying guide plate upstream from the fourth pair of sheet conveying rollers 44 (i.e., the pair of sheet conveying rollers) in the sheet conveying direction, that is, at the upstream side of the sheet conveyance passage. The sloped conveying guide plate 38 guides the sheet P so that the sheet P that contacts the fourth pair of sheet conveying rollers 44 in a rotation stop state bends toward the sheet conveying direction of the sheet P.

While the rotation of the fourth pair of sheet conveying rollers 44 (i.e., the pair of upstream side sheet conveying rollers) is stopped, the leading end of the sheet P contacts the fourth pair of sheet conveying rollers 44. By so doing, an angular displacement amount of the sheet P is corrected (i.e., the angular displacement correction). That is, the fourth pair of sheet conveying rollers 44 (i.e., the pair of upstream side sheet conveying rollers) in Embodiment 3 functions as a gate to which the leading end of the sheet P conveyed in the sheet conveyance passage contacts.

Then, before the sheet P is conveyed by the fourth pair of sheet conveying rollers 44 to the position of the pair of sheet holding rollers 31, the pair of sheet holding rollers 31 is moved in the width direction from the reference position (in the width direction) according to the lateral displacement amount of the sheet P that has been detected by the first CIS 36 (i.e., a first detector). Then, the pair of sheet holding rollers 31 is moved (returned) to the reference position while holding the sheet P, so that the lateral displacement amount of the sheet p is corrected (i.e., the lateral displacement correction).

Then, after the angular displacement amount of the sheet P is corrected by the fourth pair of sheet conveying rollers 44 and the lateral displacement amount of the sheet P is corrected by the pair of sheet holding rollers 31, the first CIS 36 that functions as a first detector and the second CIS 37 that functions as a second detector consecutively detect a subsequent lateral displacement amount and a subsequent angular displacement amount of the sheet P while the pair of sheet holding rollers 31 is holding the sheet P. Then, the pair of sheet holding rollers 31 while holding the sheet P is moved in the rotation direction of the sheet P from the reference position, so that the subsequent lateral displacement amount and the subsequent angular displacement amount of the sheet P are corrected with the feedback control, based on the detection results obtained by the first CIS 36 and the second CIS 37.

As described above, in Embodiment 3, the leading end of the sheet P contacts the fourth pair of sheet conveying rollers 44 as the pair of upstream side sheet conveying rollers that functions as a gate first. Then, based on the detection result of the first CIS 36 that functions as a first detector, the pair of sheet holding rollers 31 is moved in the width direction while holding the sheet P, so as to perform the primary correction to correct the position of the sheet P. Then, after the primary correction, the first CIS 36 that functions as a first detector and the second CIS 37 that functions as a second detector detect the position of the sheet P while the sheet P is being held and conveyed by the pair of sheet holding rollers 31. Based on the detection results of the first CIS 36 and the second CIS 37, the pair of sheet holding rollers 31 is moved in the width direction and the rotation direction of the sheet P so as to perform the secondary correction to correct the position of the sheet P.

Now, a description is given of an example of operations of the sheet conveying device 30 according to Embodiment 3.

It is to be noted that FIGS. 11A, 11C, 11E, 11G, 12A, 12C and 12E are top views illustrating operations of the sheet conveying device 30 in this order and that FIGS. 11B, 11D, 11F, 11H, 12B, 12D and 12F are side views illustrating the operations of the sheet conveying device 30 corresponding to FIGS. 11A, 11C, 11E, 11G, 12A, 12C and 12E, respectively.

Figure 11A:
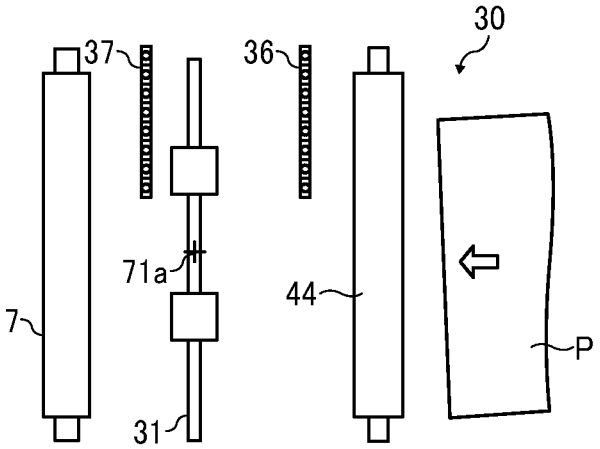
FIGS. 11A, 11B, 11C, 11D, 11E, 11F, 11G and 11H is a diagram illustrating operations of the sheet conveying device according to Embodiment 3 of this disclosure.
Figure 11B:
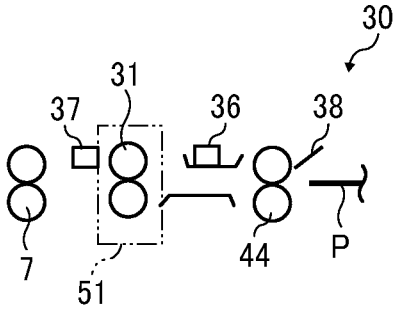

First, as illustrated in FIGS. 11A and 11B, the sheet P fed from the first sheet feeding unit 12 is held and conveyed toward the position of the fourth pair of sheet conveying rollers 44 (the pair of upstream side sheet conveying rollers) in a direction indicated by white arrow. At this time, the fourth pair of sheet conveying rollers 44 is in the rotation stop state.

Figure 11C:
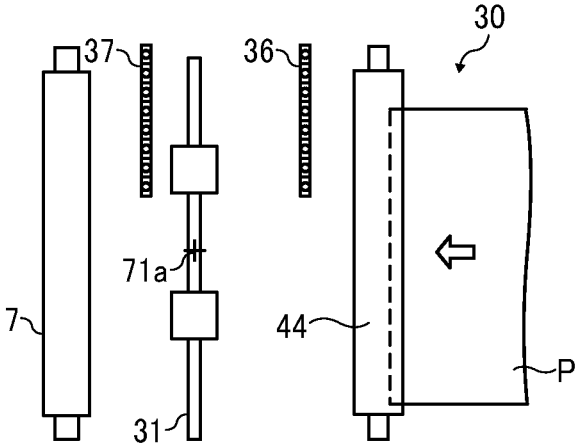
Figure 11D:
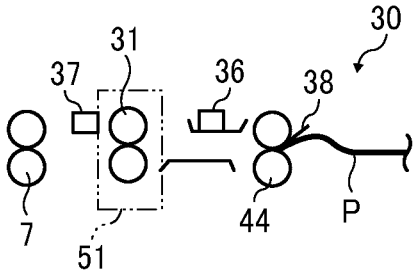

Then, as illustrated in FIGS. 11C and 11D, when the leading end of the sheet P contacts the nip region of the fourth pair of sheet conveying rollers 44 (i.e., a gate) that is in the rotation stop state, a pair of sheet conveying rollers disposed upstream from the pair of sheet conveying rollers 44 holds and conveys the sheet P for a relatively short time after the contact. By so doing, the sheet P curves along the sloped conveying guide plate 38 and the leading end of the curved sheet P contacts the nip region of the fourth pair of sheet conveying rollers 44 over the entire width direction of the sheet P. Accordingly, the first angular displacement correction is performed.

At this time, the position of the pair of sheet holding rollers 31 in the rotation direction is located in the first reference position, which is a normal position corresponding to the sheet P that has no angular displacement, and the position thereof in the width direction is located in the second reference position, which is a normal position corresponding to the sheet P that has no lateral displacement.

Figure 11E:
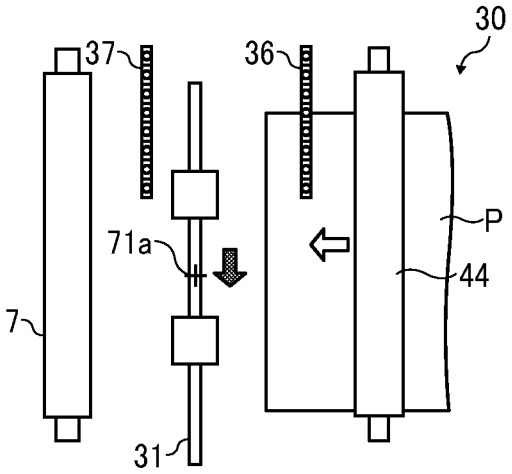
Figure 11F:
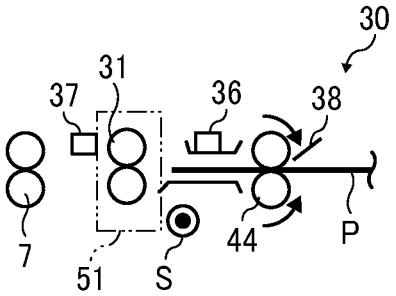

Then, as illustrated in FIGS. 11E and 11F, the fourth pair of sheet conveying rollers 44 starts to rotate (in a direction indicated by arrow in FIG. 11E). Consequently, the sheet P to which the angular displacement correction has been performed is held and conveyed by the fourth pair of sheet conveying rollers 44 to the position of the pair of sheet holding rollers 31 in a direction indicated by white arrow in FIG. 11F.

At this time, the first CIS 36 detects the lateral displacement amount $\alpha$ of the sheet P while the fourth pair of sheet conveying rollers 44 is holding and conveying the sheet P. Then, as illustrated in FIGS. 11E and 11E, the pair of sheet holding rollers 31 moves from the second reference position by the distance $\alpha$ in a direction to cancel out the lateral displacement amount $\alpha$ of the sheet P that is detected by the first CIS 36.

Figure 11G:
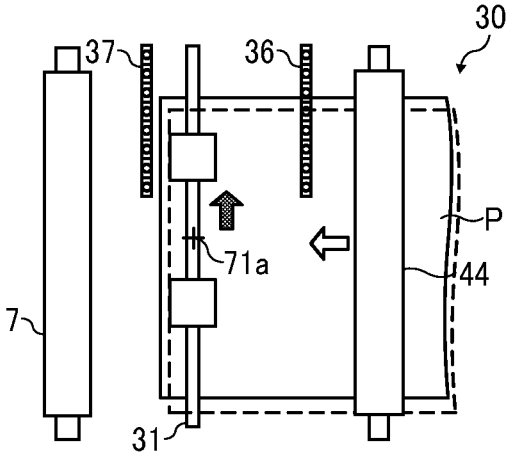
Figure 11H:
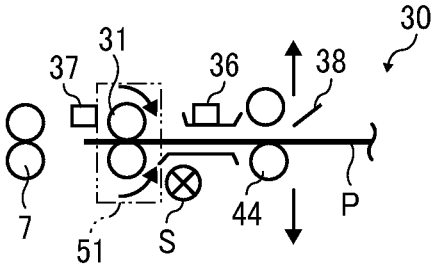

Then, as illustrated in FIGS. 11G and 11H, the pair of sheet holding rollers 31 starts to rotate (in a direction indicated by arrow in FIG. 11G) immediately before the leading end of the sheet P reaches the pair of sheet holding rollers 31. Consequently, as the sheet P is held and conveyed by the pair of sheet holding rollers 31, the fourth pair of sheet conveying rollers 44 opens the sheet conveyance passage and moves to a direction indicated by arrow in FIG. 11F in which the fourth pair of sheet conveying rollers 44 does not hold the sheet P. Then, the pair of sheet holding rollers 31 moves in the width direction to return to the second reference position to cancel out the lateral displacement amount $\alpha$ of the sheet P that is detected by the first CIS 36. Thus, the first lateral displacement correction is performed to the sheet P.

It is to be noted that the calculator (the controller 160) can obtain a time at which the leading end of the sheet P contacts the pair of sheet holding rollers 31 based on a time at which the first CIS 36 detects the leading end of the sheet P, a conveying speed of the sheet P and a distance from the position of the first CIS 36 to the position of the pair of sheet holding rollers 31.

Figure 12A:
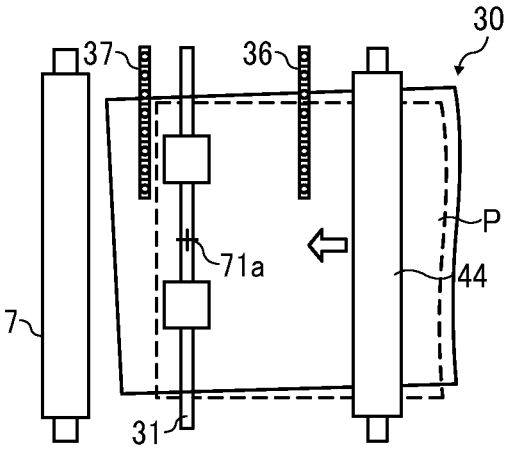
FIGS. 12A, 12B, 12C, 12D, 12E and 12F are diagrams illustrating operations of the sheet conveying device, subsequent from the operations of FIGS. 11A through 11H.
Figure 12B:
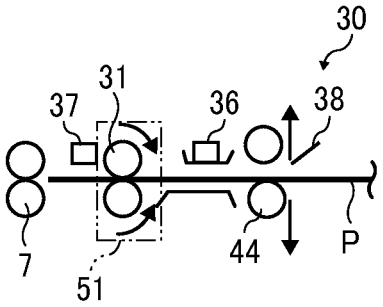

Then, as illustrated in FIGS. 12A and 12B, when the sheet P after completion of the above-described correction reaches the position of the second CIS 37, the first CIS 36 and the second CIS 37 continuously detect the lateral displacement amount $\alpha$ and the angular displacement amount $\beta$ of the sheet P that is being held and conveyed by the pair of sheet holding rollers 31.

Figure 12C:
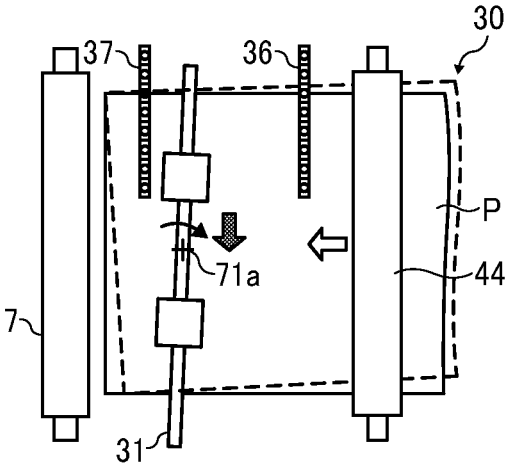
Figure 12D:
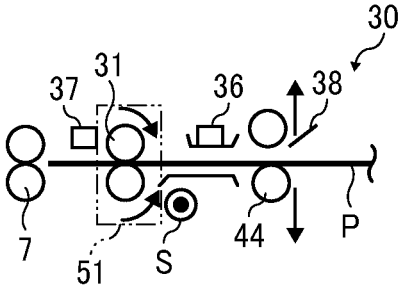

Then, as illustrated in FIGS. 12C and 12D, while holding and conveying the sheet P, the pair of sheet holding rollers 31 moves in the width direction (indicated by black arrow in FIG. 12D) from the corrected position of FIG. 12A by the distance $\alpha$ in a direction to cancel out the lateral displacement amount $\alpha$ detected by the first CIS 36 and the second CIS 37. Further, at a substantially same time, the pair of sheet holding rollers 31 moves while holding and conveying the sheet P in the rotation direction (indicated by black arrow in FIG. 12D) from the first reference position of FIG. 12A by the angle $\beta$ about the shaft 71*a* in a direction to cancel out the angular displacement amount $\beta$ detected by the first CIS 36 and the second CIS 37.

Thus, the sheet P is conveyed toward the transfer roller 7 in the image forming area while the lateral displacement correction and the angular displacement correction are being performed to the sheet P again. At this time, the number of rotations of the pair of sheet holding rollers 31 (the speed of conveyance of the sheet P until the sheet P arrives the transfer roller 7) is varied so as to synchronize (at a synchronized time) with movement of the toner image formed on the surface of the photoconductor drum 5.

Figure 12E:
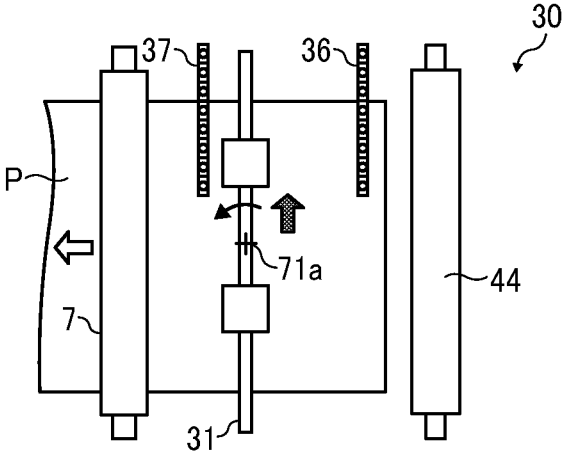
Figure 12F:
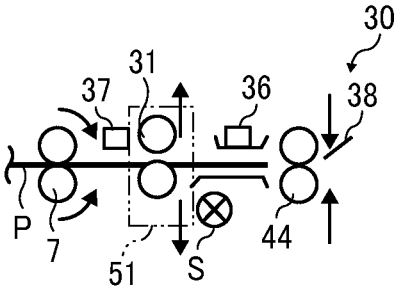

Then, as illustrated in FIGS. 12E and 12F, the sheet P is conveyed toward the transfer roller 7 (the image forming area) and the toner image is transferred onto the sheet P at a desired position. At this time, as the sheet P is conveyed by the transfer roller 7, the pair of sheet holding rollers 31 opens the sheet conveyance passage and moves to a direction indicated by arrow in FIG. 12F in which the pair of sheet holding rollers 31 does not hold the sheet P. Then, the pair of sheet holding rollers 31 is returned to the first reference position and the second reference position for preparation of the angular displacement correction and the lateral displacement correction of a subsequent sheet P.

Further, the fourth pair of sheet conveying rollers 44 in the roller separated state is returned to the roller contact state for preparation of conveyance of the subsequent sheet P. Thereafter, when the trailing end of the sheet P passes the pair of sheet holding rollers 31, the pair of sheet holding rollers 31 closes the sheet conveyance passage and the rollers of the pair of sheet holding rollers 31 move to contact with each other in a direction to hold the sheet P. Accordingly, the pair of sheet holding rollers 31 returns to the state as illustrated in FIGS. 11A and 11B for preparation of the angular displacement correction of the subsequent sheet P.

By repeating the above-described operations, a series of operations performed by the sheet conveying device 30 completes.

As described above, in the sheet conveying device 30 according to Embodiment 3, when the sheet P is conveyed toward the fourth pair of sheet conveying rollers 44 that functions as a gate in the rotation stop state, the leading end of the sheet P contacts the fourth pair of sheet conveying rollers 44 to correct the angular displacement amount of the sheet P. Then, based on the detection result of the first CIS 36 that functions as a first detector, the pair of sheet holding rollers 31 is moved in the width direction while holding the sheet P to correct the lateral displacement amount of the sheet P. Then, after the fourth pair of sheet conveying rollers 44 and the pair of sheet holding rollers 31 have corrected the angular displacement amount and the lateral displacement amount of the sheet P, the first CIS 36 that functions as a first detector and the second CIS 37 that functions as a second detector detect a subsequent lateral displacement amount and a subsequent angular displacement amount of the sheet P that occur after the above-described correction of the sheet P. Based on the detection results of the first CIS 36 and the second CIS 37, the pair of sheet holding rollers 31 is moved in the width direction and the rotation direction of the sheet P so that the subsequent lateral displacement amount and the subsequent angular displacement amount of the sheet P are corrected.

According to these operations, the sheet P after the corrections of angular displacement and lateral displacement does not move again in the rotation direction and the width direction and the corrections of angular displacement and lateral displacement of the sheet P can be performed with higher accuracy.

Embodiment 4

Figure 13:
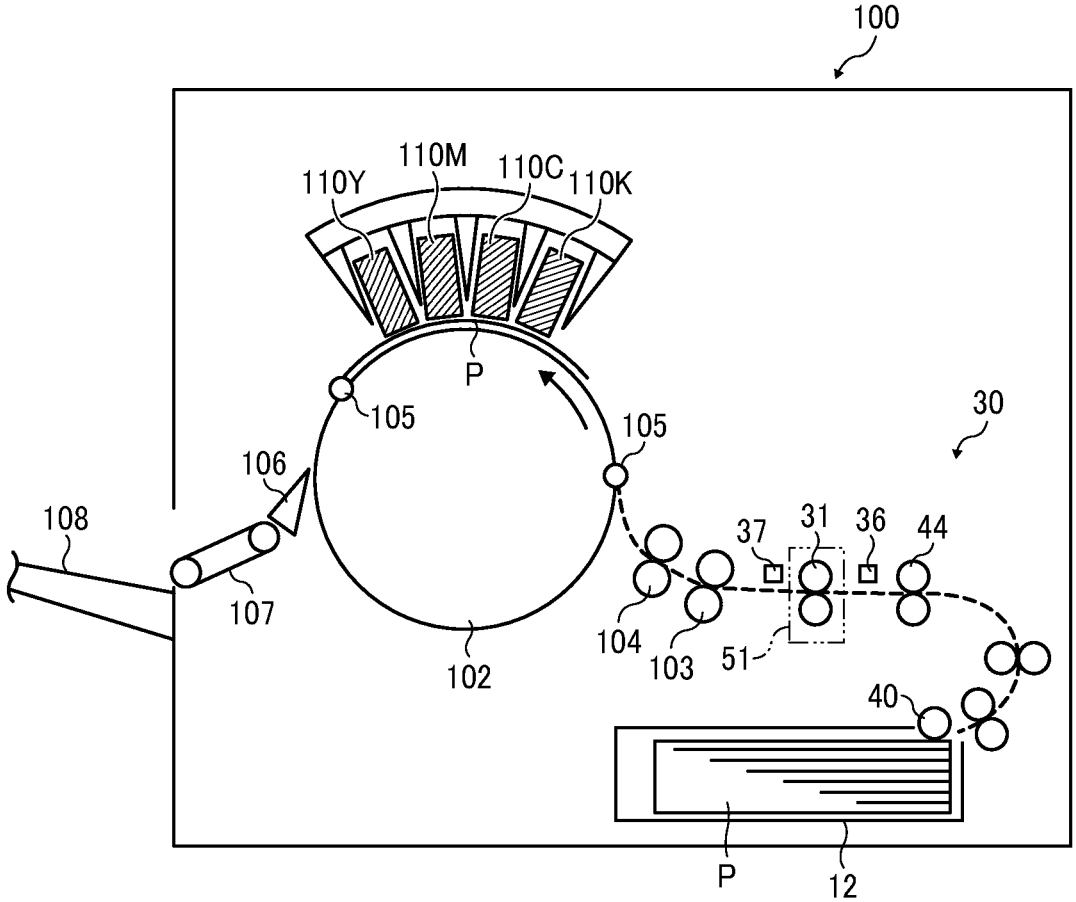
FIG. 13 is a diagram illustrating an overall configuration of an image forming apparatus according to Embodiment 4 of this disclosure.

Next, a description is given of a configuration and functions of the sheet conveying device 30 and an image forming apparatus 100, according to Embodiment 4 of this disclosure, with reference to FIG. 13.

FIG. 13 is a diagram illustrating an overall configuration of the image forming apparatus 100 according to Embodiment 4 of this disclosure. The configuration and functions of the image forming apparatus 100 illustrated in FIG. 13 according to Embodiment 4 is basically identical to the configuration and functions of the image forming apparatus 1 according to Embodiments 1, 2 and 3, except that the image forming apparatus 100 according to Embodiment 4 is an inkjet printer while the image forming apparatus 1 according to Embodiments 1, 2 and 3 is an electrophotographic image forming apparatus.

In FIG. 13, the image forming apparatus 100 includes a conveyance drum 102, pairs of sheet conveying rollers 103 and 104, a sheet gripper 105, a separating member 106, a conveying belt 107, a sheet discharging tray 108, and ink print heads 110Y, 110M, 110C and 110K. The conveyance drum 102 conveys the sheet P. The pairs of sheet conveying rollers 103 and 104 conveys the sheet P. The sheet gripper 105 grips the sheet P on the conveyance drum 102. The separating member 106 separates the sheet p from the conveyance drum 102. The conveying belt 107 conveys the sheet P separated from the conveyance drum 102. The sheet discharging tray 108 discharges and stacks the sheet P after image formation and print is completed.

Each of the ink print heads 110Y, 110M, 110C and 110K is a single unit (i.e., a print module) including an image forming device to form and print an image with an inkjet method.

Similar to the electrophotographic image forming apparatus 1 according to Embodiment 1, 2 and 3, the image forming apparatus 100 according to Embodiment 4 includes the sheet conveying device 30.

The image forming apparatus 100 according to Embodiment 4 is to form a color image and, as illustrated in FIG. 13, includes the ink print head 110K for black image and the ink print heads 110Y, 110M and 110C for yellow, magenta and cyan images, respectively. The ink print heads 110Y, 110M, 110C and 110K are aligned to face the conveyance drum 102 along the rotation direction of the conveyance drum 102.

It is to be noted that the four ink print heads 110Y, 110M, 110C and 110K have the configuration identical to each other except for the ink colors (types). The ink print heads 110Y, 110M, 110C and 110K includes a piezoelectric actuator and a thermal actuator for a main part, nozzles used to discharge ink as liquid droplets, ink tanks filled with ink, a control board (a controller) and so forth.

Now, a description is given of operations performed by the image forming apparatus 100, with reference to FIG. 13.

First, as a print instruction is inputted together with image data from, for example, a personal computer to the controller of the image forming apparatus 100, the sheet P is fed by the sheet feed roller from the first sheet feed unit 12. The sheet P fed from the first sheet feed unit 12 is conveyed by the sheet conveying device 30 to the conveyance drum 102. At this time, similar to Embodiment 1 through Embodiment 3, in the sheet conveying device 30 of Embodiment 4, the pair of sheet holding rollers 31 performs the corrections of lateral and angular displacements of the sheet P based on the detection results of the first CIS 36 and the second CIS 37.

By contrast, the ink print heads 110Y, 110M, 110C and 110K convert and form image writing data based on the image data input to the controller.

Consequently, the sheet P conveyed to the conveyance drum 102 is positioned on the conveyance drum 102 while being gripped by the sheet gripper 105, and is conveyed in a counterclockwise direction along the rotation of the conveyance drum 102.

Then, based on the image writing data, ink as liquid droplets is sequentially sprayed from the ink print heads 110Y, 110M, 110C and 110K onto the sheet P conveyed in a direction indicated by arrow in FIG. 13 due to the rotation of the conveyance drum 102. By so doing, a desired color image is formed on the sheet P.

Thereafter, the sheet P having the desired image thereon is separated from the conveyance drum 102 by the separating member 106. Then, the sheet P separated from the conveyance drum 102 is conveyed by the conveying belt 107 to be discharged to the sheet discharging tray 108.

As described above, similar to the sheet conveying device 30 according to Embodiment 1 through Embodiment 3, the sheet conveying device 30 (of the image forming apparatus 100) according to Embodiment 4 performs the correction of positional deviation of the sheet P with the pair of sheet holding rollers 31. Specifically, as the leading end of the sheet P contacts the pair of sheet holding rollers 31, the angular displacement of the sheet P is corrected. Then, based on the detection result of the first CIS 36 that functions as a first detector, the pair of sheet holding rollers 31 moves in the width direction to correct the lateral displacement of the sheet P. Then, after the first CIS 36 that functions as a first detector and the second CIS 37 that functions as a second detector detect respective amounts of positional deviation of the sheet P, that is, the lateral displacement amount of the sheet P and the angular displacement amount of the sheet P, the pair of sheet holding rollers 31 moves in the width direction and the rotation direction of the sheet P such that the lateral and angular displacements of the sheet P are further corrected based on the detection results of the first CIS 36 and the second CIS 37.

According to these operations, the sheet P after the corrections of angular displacement and lateral displacement does not move again in the rotation direction and the width direction and the corrections of angular displacement and lateral displacement of the sheet P can be performed with higher accuracy.

Embodiment 5

Next, a description is given of a configuration and functions of the sheet conveying device 30 and the image forming apparatus 1, according to Embodiment 5 of this disclosure.

Figure 14:
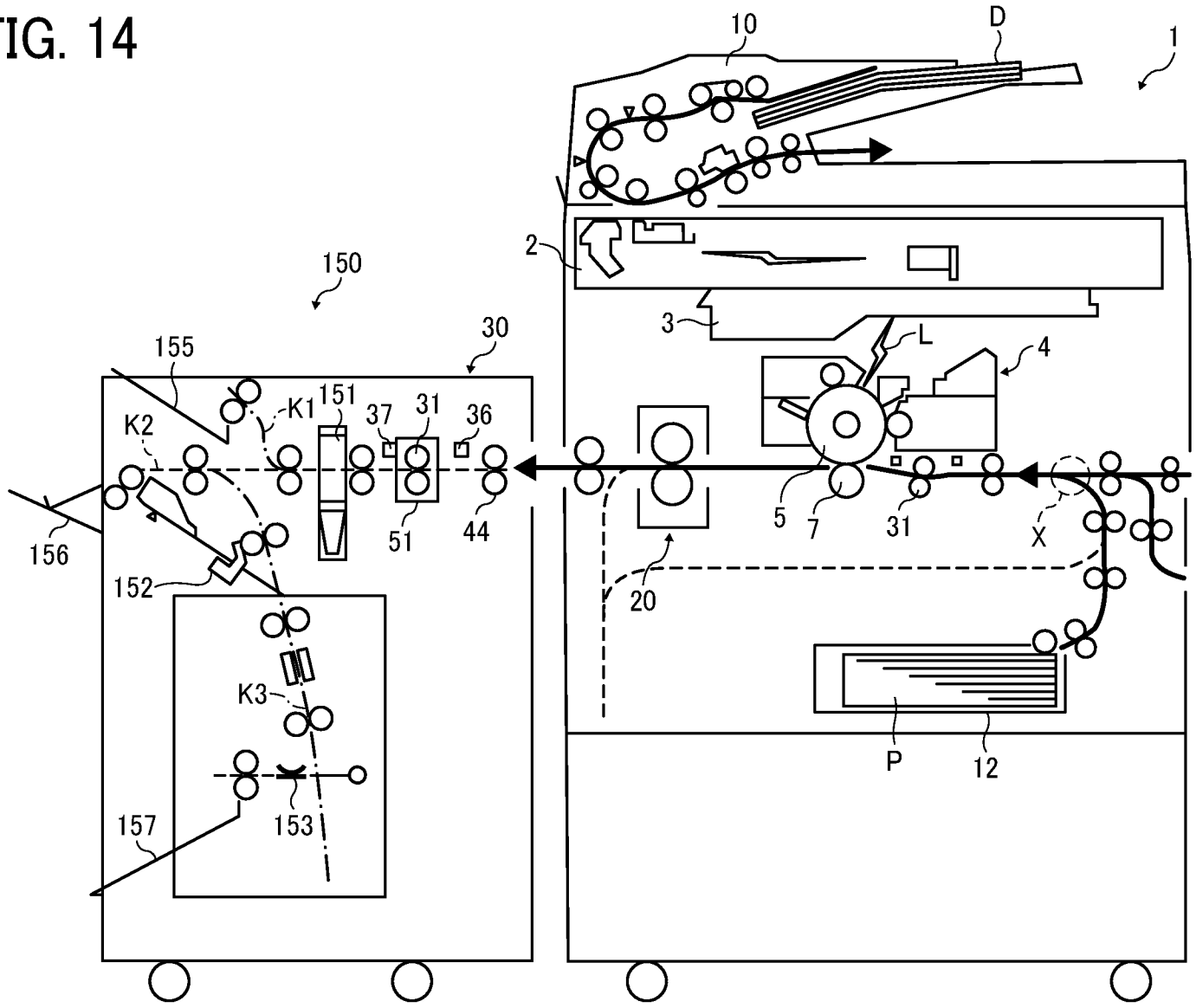
FIG. 14 is a diagram illustrating an overall configuration of an image forming apparatus according to Embodiment 5 of this disclosure.

FIG. 14 is a diagram illustrating an overall configuration of the image forming apparatus 1 according to Embodiment 5 of this disclosure.

The configuration and functions of the image forming apparatus 1 according to Embodiment 5 is basically identical to the configuration and functions of the image forming apparatus 1 according to Embodiment 1 through Embodiment 4, except that the image forming apparatus 1 of Embodiment 5 includes a post processing device 150 that performs post processing operations such as punching, sheet binding and sheet folding, to the sheet P after completion of image formation.

The post processing device 150 illustrated in FIG. 14 is detachably attached to the apparatus body of the image forming apparatus 1 and includes a punching device 151, a binding device 152, a sheet folding device 153 and multiple trays (sheet stackers), which are a first discharging tray 155, a second sheet discharging tray 156 and a third sheet discharging tray 157. The punching device 151 performs a punching process to punch or open holes on a sheet P. The binding device 152 performs a stapling process and a binding process of a sheet P. The sheet folding device 153 performs a folding process of a sheet P after image formation.

The post processing device 150 according to Embodiment 5 also includes the sheet conveying device 30 that is similar to the sheet conveying device 30 according to Embodiment 1 through Embodiment 4.

It is to be noted that the post processing device 150 further includes a first sheet conveyance passage K1, a second sheet conveyance passage K3 and a third sheet conveying passage K3.

The first sheet conveyance passage K1 is a sheet conveyance passage to convey a sheet P to which the punching process is performed in the punching device 151 or a sheet P to which no post processing process is performed, to the first discharging tray 155.

The second sheet conveyance passage K2 is a sheet conveyance passage to convey a sheet P toward the binding device 152 and a bundle of sheets P after completion of the stapling process and/or the binding process to the second sheet discharging tray 156.

The third sheet conveyance passage K3 is a sheet conveyance passage to convey a sheet P toward the sheet folding device 153 and the sheet P after completion of the center folding process to the third sheet discharging tray 157.

Now, a description is given of regular image forming operations performed by the post processing device 150, with reference to FIG. 14.

First, after having been discharged from the apparatus body of the image forming apparatus 1, the sheet P is convened into the post processing device 150. Then, similar to Embodiment 1 through Embodiment 4, in the sheet conveying device 30 of Embodiment 5, the pair of sheet holding rollers 31 performs the corrections of angular and lateral displacements of the sheet P based on the detection results of the two CISs, which are the first CIS 36 and the second CIS 37. The sheet P after the corrections of angular and lateral displacement is conveyed to any one of the first sheet conveying passage K1, the second sheet conveying passage K2 and the third sheet conveying passage K3 according to a post processing operation instructed by a user. After the corresponding post processing operation has been performed to the sheet P, the sheet P is discharged to any one of the first discharging tray 155, the second sheet discharging tray 156 and the third sheet discharging tray 157.

As described above, similar to the sheet conveying device 30 according to Embodiment 1 through Embodiment 4, the sheet conveying device 30 (functioning as a gate) of the post processing device 150 according to Embodiment 5 performs the correction of positional deviation of the sheet P with the pair of sheet holding rollers 31. Specifically, as the leading end of the sheet P contacts the pair of sheet holding rollers 31, the angular displacement of the sheet P is corrected. Then, based on the detection result of the first CIS 36 that functions as a first detector, the pair of sheet holding rollers 31 moves to correct the lateral displacement of the sheet P. Then, after the first CIS 36 that functions as a first detector and the second CIS 37 that functions as a second detector detect respective amounts of positional deviation of the sheet P, that is, the amount of lateral displacement of the sheet P and the amount of angular displacement of the sheet P, the pair of sheet holding rollers 31 moves such that the lateral and angular displacements of the sheet P are further corrected based on the detection results of the first CIS 36 and the second CIS 37.

According to these operations, the sheet P after the corrections of angular and lateral displacements does not move again in the rotation direction and the width direction and the corrections of angular and lateral displacements of the sheet P can be performed with higher accuracy.

Specially, the post processing device 150 in Embodiment 5 can reduce the amount of positional deviation of the sheet P and provide the post processing operations with high accuracy.

Figure 15:
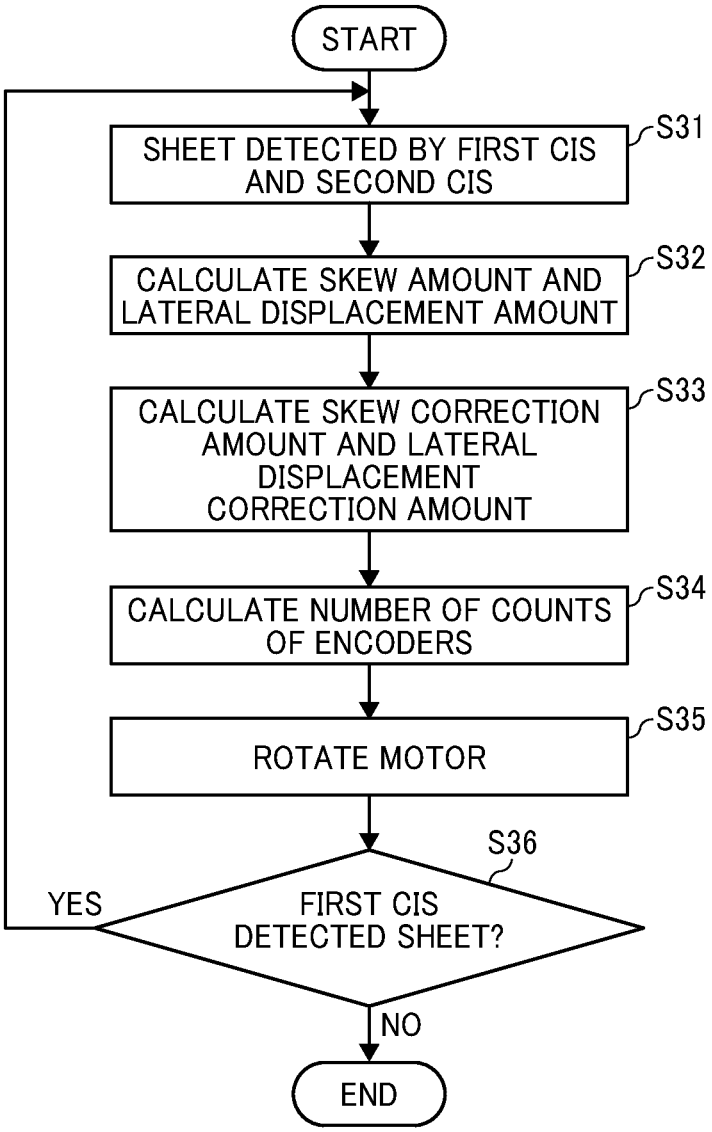
FIG. 15 is a flowchart of control operations of a secondary correction.
Figure 16:
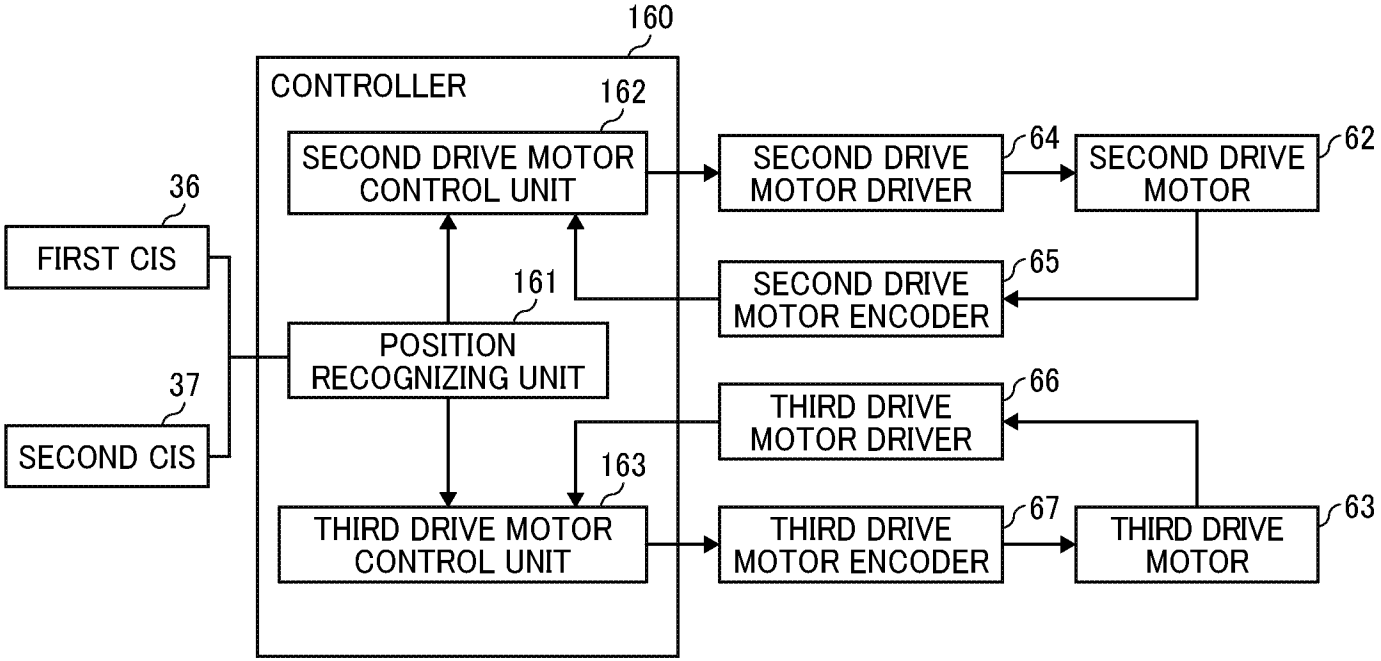
FIG. 16 is a block diagram illustrating a controller.

Now, a description is given of a secondary correction performed in the sheet conveying device 30 according to Embodiment 1 through Embodiment 5 of this disclosure, with reference to FIGS. 15 and 16.

FIG. 15 is a flowchart of control operations of the secondary correction (the recorrection). FIG. 16 is a block diagram illustrating the controller 160 related to the secondary correction.

As illustrated in FIG. 15, firstly in the secondary correction, the first CIS 36 and the second CIS 37 detect the sheet P, in step S31. Then, the amount of lateral displacement of the sheet P and the amount of angular displacement of the sheet P are calculated, in step S32. Then, based on the detection result, the correction amount of lateral displacement of the sheet P and the correction amount of angular displacement of the sheet P are calculated, in step S33. Then, respective encoders (i.e., a second drive motor encoder 65 and a third drive motor encoder 67 in FIG. 16) calculate the respective numbers of counts, in step S34. Thereafter, respective motor drivers (i.e., a second drive motor driver 64 and a third drive motor driver 66 in FIG. 16) drive the second drive motor 62 and the third drive motor 63 according to the calculated numbers of counts of the encoders (i.e., the second drive motor encoder 65 and the third drive motor encoder 67), in step S35. And, in step S36, the above-described operations of steps S31 through S35 of the flow illustrated in FIG. 15 are repeated while first CIS 36 is detecting the sheet P (that is, while the first CIS 36 and the second CIS 37 can detect the respective positions of the sheet P).

In the secondary correction, the first CIS 36 and the second CIS 37 continuously detect the position information of the sheet P after the start of the secondary correction. The amount of lateral displacement of the sheet P and the amount of angular displacement of the sheet P are calculated based on the position information detected by the first CIS 36 and the second CIS 37, and then the amounts are fed back to the controller 160 where the numbers of counts of the respective encoders (that is, the correction amount of lateral displacement of the sheet P and the correction amount of angular displacement of the sheet P) are updated consecutively. By performing the feedback control as described above, the positional deviation of the sheet P that may occur in the secondary correction and the correction error in the secondary correction can be modified, and therefore the correction with higher accuracy are performed.

In FIG. 16, the controller 160 controls various operations in the image forming apparatus 1. A position recognizing unit 161 in the controller 160 counts the amount of lateral displacement of the sheet P and the amount of angular displacement of the sheet P from information received from the CIS 36 and the CIS 37. Further, the second drive motor control unit 162 determines the amounts of driving of the second drive motor 62 (i.e., the angle and direction of rotation of the second drive motor 62) based on the amount of angular displacement of the sheet P obtained by the position recognizing unit 161. Further, the third drive motor control unit 163 determines the amounts of driving of the third drive motor 63 (i.e., the angle and direction of rotation of the third drive motor 63) based on the amount of lateral displacement of the sheet P in the width direction obtained by the position recognizing unit 161. The second drive motor driver 64 receives a signal from the second drive motor control unit 162 to drive the second drive motor 62. Similarly, the third drive motor driver 66 receives a signal from the third drive motor control unit 163 to drive the third drive motor 63. The second drive motor encoder 65 detects the amount of rotation of the second drive motor 62 and the third drive motor encoder 67 detects the amount of rotation of the third drive motor 63.

It is to be noted that each configuration of the sheet conveying device 30 according to the above-described embodiments employs the pair of sheet holding rollers 31 that functions as a pair of lateral and angular displacement correction rollers also functions as a pair of registration rollers to convey the sheet P in synchronization with movement of the image formed on the surface of the photoconductor drum 5. However, the configuration of the sheet conveying device 30 applicable to this disclosure is not limited thereto. That is, any other configuration can be applied to the sheet conveying device according to this disclosure as long as the sheet conveying device performs the correction of angular displacement of the sheet P and the correction of lateral displacement of the sheet P. For example, the sheet conveying device that has a pair of registration rollers disposed downstream from the pair of sheet holding rollers 31 functioning as a pair of lateral and angular displacement correction rollers can be applied to this disclosure.

Further, in the above-described examples, the sheet conveying device 30 performs the correction of angular displacement of a transfer sheet and the correction of lateral displacement of a transfer sheet as the sheet P on which an image is formed. However, this disclosure is also applicable to the sheet conveying device 30 performs correction of angular displacement of an original document and correction of lateral displacement of an original document as the sheet P.

Further, in the above-described examples, the sheet conveying device 30 is provided to the image forming apparatus 1 for creating monochrome or black and white copies. However, the sheet conveying device 30 is not limited thereto and can be provided to a color image forming apparatus.

Further, in the above-described examples, the sheet conveying device 30 is provided to the electrophotographic image forming apparatus 1, the inkjet image forming apparatus 100 and the post processing device 150. However, the sheet conveying device 30 is not limited thereto and can be provided to any other type of image forming apparatuses such as an offset printing machine as long as the sheet conveying device 30 performs the correction of angular displacement of the sheet P and the correction of lateral displacement of the sheet P.

Further, the above-described configurations can achieve the same effect as each configuration of the sheet conveying device 30.

Further, each configuration of the above-described examples employs each of the CIS 36 that functions as a first detector and the CIS 37 that functions as a second detector to be applied to this disclosure. However, the configuration is not limited thereto. For example, instead of these CISs 36 and 37, a transparent type edge sensor can be employed as a sensor to detect the position at the end part of the sheet P in the width direction.

Further, in the above-described embodiments, the CIS 36 and the CIS 37 detects the amounts of positional deviations, which are the lateral displacement amount of the sheet p and the angular displacement of the sheet P. However, the configuration is not limited thereto. For example, when one of the lateral displacement and the angular displacement is sufficient to be corrected again, the CIS 36 and the CIS 37 detect the one of the lateral displacement and the angular displacement.

The above-described embodiments are illustrative and do not limit this disclosure. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set.

As described above, it is to be noted that the "width direction" is defined as a direction perpendicular to the sheet conveying direction of the sheet P.

It is to be noted that, as described above, a "sheet" in the above-described embodiments of this disclosure is not limited to indicate a (regular) paper but also includes any other sheet-like material such as coated paper, label paper, OHP film sheet, and film.

The above-described embodiments are illustrative and do not limit this disclosure. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of this disclosure may be practiced otherwise than as specifically described herein.

What is claimed is:

1. A sheet conveying device comprising:

at least one drive device;

a pair of sheet holding rollers configured to be moved by the at least one drive device under control of a controller, the pair of sheet holding rollers configured to convey a sheet, while holding the sheet, in a sheet conveying direction;

a first detector upstream from the pair of sheet holding rollers in the sheet conveying direction, the first detector configured to detect a position of the sheet conveyed in a sheet conveyance passage; and a second detector downstream from the pair of sheet holding rollers in the sheet conveying direction, the second detector configured to detect a position of the sheet conveyed in the sheet conveyance passage, wherein the pair of sheet holding rollers are configured to, under control of the controller, perform a primary correction in which the at least one drive device causes the pair of sheet holding rollers to move in a width direction based on a detection result of the first detector while the sheet is held by sheet holding rollers after a leading end of the sheet has contacted one of (i) a nip region formed by the sheet holding rollers while rotation of the sheet holding rollers is stopped or (ii) a discrete gate, and perform a secondary correction in which the at least one drive device causes the pair of sheet holding rollers to move in at least one of the width direction and a rotation direction based on a detection result of the first detector and the second detector after the primary correction.

2. The sheet conveying device according to claim 1, wherein the primary correction is performed while the sheet is held by sheet holding rollers after the leading end of the sheet contacts the pair of sheet holding rollers, to perform the primary correction, the pair of sheet holding rollers is configured to, under control of the controller, (1) correct an angular displacement amount of the sheet by contacting the leading end of the sheet conveyed toward the pair of sheet holding rollers while rotation of the pair of sheet holding rollers by the at least one drive device is being stopped, and (2) move, while holding and conveying the sheet, from a reference position to a corrected position, operable to perform a correction of a lateral displacement amount of the sheet based on a detection result obtained by the first detector, and to perform the secondary correction, the after the correction of the lateral displacement amount of the sheet, the pair of sheet holding rollers is configured to, under control of the controller, (1) move the pair of sheet holding rollers while holding the sheet from the corrected position, operable to correct at least one of a subsequent lateral displacement amount of the sheet and the angular displacement amount of the sheet based on the at least one of a detection result of the subsequent lateral displacement amount of the sheet and a detection result of the angular displacement amount of the sheet, continuously obtained by the first detector and the second detector, while the pair of sheet holding rollers is holding the sheet.

3. The sheet conveying device according to claim 1, further comprising:

a projection configured to function as the discrete gate, the projection configured to rotate together with a drive roller of the pair of sheet holding rollers, wherein to perform the primary correction, the pair of sheet holding rollers is configured to, under control of the controller, (1) correct an angular displacement amount of the sheet by contacting the leading end of the sheet conveyed toward the pair of sheet holding rollers while rotation of the pair of sheet holding rollers by the at least one drive device is being stopped, and (2) move, while holding and conveying the sheet, from a reference position to a corrected position, operable to perform a correction of a lateral displacement amount of the sheet based on a detection result obtained by the first detector, and to perform the secondary correction, after the correction of the lateral displacement amount of the sheet, the pair of sheet holding rollers is configured to, under control of the controller, (1) move the pair of sheet holding rollers while holding the sheet from the corrected position, operable to correct at least one of a subsequent lateral displacement amount of the sheet and the angular displacement amount of the sheet based on the at least one of a detection result of the subsequent lateral displacement amount of the sheet and a detection result of the angular displacement amount of the sheet, continuously obtained by the first detector and the second detector, while the pair of sheet holding rollers is holding the sheet.

4. The sheet conveying device according to claim 1, further comprising:

a pair of upstream side sheet conveying rollers and another drive device associated therewith to drive the pair of upstream side sheet conveying rollers, the pair of upstream side sheet conveying rollers configured to function as the discrete gate, the pair of upstream side sheet conveying rollers upstream from the pair of sheet holding rollers in the sheet conveying direction, wherein the first detector is downstream from the pair of upstream side sheet conveying rollers in the sheet conveying direction, to perform the primary correction, the pair of upstream side sheet conveying rollers is configured to, under control of the controller, (1) correct an angular displacement amount of the sheet by contacting the leading end of the sheet conveyed toward the pair of upstream side sheet conveying rollers while rotation of the pair of upstream side sheet conveying rollers is being stopped, (2) move from a reference position in the width direction corresponding to a lateral displacement amount of the sheet based on a detection result obtained by the first detector before the sheet is conveyed to the pair of sheet holding rollers by the pair of upstream side sheet conveying rollers, and (3) move the pair of sheet holding rollers while holding the sheet to the reference position, operable to perform a correction of the lateral displacement amount of the sheet, and to perform the secondary correction, after the correction of the lateral displacement amount of the sheet, the pair of sheet holding rollers is configured to, under control of the controller, (1) move while holding the sheet from the reference position, operable to correct at least one of a subsequent lateral displacement amount of the sheet and the angular displacement amount of the sheet, with a feedback control, based on the at least one of a detection result of the subsequent lateral displacement amount of the sheet and a detection result of the angular displacement amount of the sheet, continuously obtained by the first detector and the second detector, while the pair of sheet holding rollers is holding and conveying the sheet.

5. The sheet conveying device according to claim 1, further comprising:

a downstream side sheet conveying roller downstream from the pair of sheet holding rollers in the sheet conveying direction and configured to convey the sheet in the sheet conveying direction, wherein the first detector is a first contact image sensor including multiple photosensors aligned in the width direction of the sheet, and the second detector is a second contact image sensor including multiple photosensors aligned in the width direction of the sheet, the second contact image sensor being downstream from the pair of sheet holding rollers in the sheet conveying direction and upstream from the downstream side sheet conveying roller in the sheet conveying direction.

6. The sheet conveying device according to claim 5, wherein, when the pair of sheet holding rollers is moved in at least one of the width direction and the rotation direction by the at least one drive device under control of the controller based on the detection result of the first contact image sensor and the detection result of the second contact image sensor, a lateral displacement amount of the sheet is detected based on a mean value of the lateral displacement amount of the sheet detected by the first contact image sensor and the lateral displacement amount of the sheet detected by the second contact image sensor, and an angular displacement amount of the sheet is detected based on a value obtained by dividing a difference of the lateral displacement amount of the sheet detected the first contact image sensor and the angular displacement amount of the sheet detected by the second contact image sensor by a separation distance of the first contact image sensor and the second contact image sensor in the sheet conveying direction.

7. The sheet conveying device according to claim 5, wherein the pair of sheet holding rollers is a pair of registration rollers configured to convey the sheet at a synchronized time toward an image forming area under control of the controller, and the downstream side sheet conveying roller is a transfer roller configured to contact an image bearer in the image forming area.

8. The sheet conveying device according to claim 1, further comprising:

a pair of sheet conveying rollers configured to function as the discrete gate, the pair of sheet conveying rollers having a drive roller and a driven roller configured to form the nip region together with the drive roller, wherein an angular displacement amount of the sheet is corrected by contacting the leading end of the sheet conveyed toward the pair of sheet conveying rollers to either one of the nip region of the pair of sheet conveying rollers and a projection configured to rotate together with the drive roller.

9. The sheet conveying device according to claim 1, further comprising:

a conveying guide plate upstream from the one of (i) the sheet holding rollers or (ii) the discrete gate in the sheet conveyance passage in the sheet conveying direction, the conveying guide plate configured to guide the sheet, operable to cause the sheet contacting the one of (i) the sheet holding rollers or (ii) the discrete gate to bend in the sheet conveying direction; and a movement amount detector configured to detect at least one of a lateral displacement amount of the pair of sheet conveying rollers and an angular displacement amount of the pair of sheet holding rollers.

10. An image forming apparatus comprising:

the sheet conveying device according to claim 1.

11. A sheet conveying device comprising:

at least one drive device;

a pair of sheet holding rollers moved by the at least one drive device, the pair of sheet holding rollers configured to convey a sheet, while holding the sheet, in a sheet conveying direction;

a first detector upstream from the pair of sheet holding rollers in the sheet conveying direction, the first detector configured to detect a position of the sheet conveyed in a sheet conveyance passage;

a second detector downstream from the pair of sheet holding rollers in the sheet conveying direction, the second detector configured to detect a position of the sheet conveyed in the sheet conveyance passage; and a controller configured to control a movement of the pair of sheet holding rollers based on at least one of a detection result of the first detector and a detection result of the second detector such that, after a leading end of the sheet has contacted one of (i) a nip region formed by the sheet holding rollers while rotation of the sheet holding rollers is stopped or (ii) a discrete gate and the sheet is held by the pair of sheet holding members, the controller instructs the at least one drive device to cause the pair of sheet holding rollers to move in a width direction of the sheet based on the detection result of the first detector; and the pair of sheet holding rollers to move at least one of the width direction of the sheet and a rotation direction of the sheet based on the detection result of the first detector and the detection result of the second detector while the sheet is being conveyed by the pair of sheet holding rollers.

12. The sheet conveying device according to claim 11, wherein the controller is configured to instruct the at least one drive device to cause the pair of sheet holding rollers to move in the width direction of the sheet based on the detection result of the first detector while the sheet is held by sheet holding rollers after the leading end of the sheet contacts the pair of sheet holding rollers, and the controller is configured to instruct the at least one drive device to cause the pair of sheet holding rollers to (1) correct an angular displacement amount of the sheet by contacting the leading end of the sheet conveyed toward the pair of sheet holding rollers while rotation of the pair of sheet holding rollers by the at least one drive device is being stopped, and (2) move, while holding and conveying the sheet, from a reference position to a corrected position, operable to perform a correction of a lateral displacement amount of the sheet based on a detection result obtained by the first detector, and after the correction of the lateral displacement amount of the sheet, the controller is configured to instruct the at least one drive device to cause the pair of sheet holding rollers to (1) move the pair of sheet holding rollers while holding the sheet from the corrected position, operable to correct at least one of a subsequent lateral displacement amount of the sheet and a subsequent angular displacement amount of the sheet based on the at least one of a detection result of the subsequent lateral displacement amount of the sheet and a detection result of the subsequent angular displacement amount of the sheet, continuously obtained by the first detector and the second detector, while the pair of sheet holding rollers is holding the sheet.

13. The sheet conveying device according to claim 11, further comprising:

a projection configured to function as the discrete gate, the projection configured to rotate together with a drive roller of the pair of sheet holding rollers, wherein the controller is configured to instruct the at least one drive device to cause the pair of sheet holding rollers to (1) correct an angular displacement amount of the sheet by contacting the leading end of the sheet conveyed toward the pair of sheet holding rollers while rotation of the pair of sheet holding rollers by the at least one drive device is being stopped, and (2) move, while holding and conveying the sheet, from a reference position to a corrected position, operable to perform a correction of a lateral displacement amount of the sheet based on a detection result obtained by the first detector, and after the correction of the lateral displacement amount of the sheet, the controller is configured to instruct the at least one drive device to cause the pair of sheet holding rollers to (1) move the pair of sheet holding rollers while holding the sheet from the corrected position, operable to correct at least one of a subsequent lateral displacement amount of the sheet and a subsequent angular displacement amount of the sheet based on the at least one of a detection result of the subsequent lateral displacement amount of the sheet and a detection result of the subsequent angular displacement amount of the sheet, continuously obtained by the first detector and the second detector, while the pair of sheet holding rollers is holding the sheet.

14. The sheet conveying device according to claim 11, further comprising:

a pair of upstream side sheet conveying rollers and another drive device associated therewith to drive the pair of upstream side sheet conveying rollers, the pair of upstream side sheet conveying rollers configured to function as the discrete gate, the pair of upstream side sheet conveying rollers upstream from the pair of sheet holding rollers in the sheet conveying direction, wherein the first detector is downstream from the pair of upstream side sheet conveying rollers in the sheet conveying direction, the controller is configured to instruct the another drive device to cause the pair of upstream side sheet conveying rollers to (1) correct an angular displacement amount of the sheet by contacting the leading end of the sheet conveyed toward the pair of upstream side sheet conveying rollers while rotation of the pair of upstream side sheet conveying rollers is being stopped, (2) move from a reference position in the width direction corresponding to a lateral displacement amount of the sheet based on a detection result obtained by the first detector before the sheet is conveyed to the pair of sheet holding rollers by the pair of upstream side sheet conveying rollers, and (3) move the pair of sheet holding rollers while holding the sheet to the reference position, operable to perform a correction of the lateral displacement amount of the sheet, and after the correction of the lateral displacement amount of the sheet, the controller is configured to instruct the another drive device to cause the pair of sheet holding rollers to (1) move while holding the sheet from the reference position, operable to correct at least one of a subsequent lateral displacement amount of the sheet and a subsequent angular displacement amount of the sheet, with a feedback control, based on the at least one of a detection result of the subsequent lateral displacement amount of the sheet and a detection result of the subsequent angular displacement amount of the sheet, continuously obtained by the first detector and the second detector, while the pair of sheet holding rollers is holding and conveying the sheet.

15. The sheet conveying device according to claim 11, further comprising:

a downstream side sheet conveying roller downstream from the pair of sheet holding rollers in the sheet conveying direction and configured to convey the sheet in the sheet conveying direction, wherein the first detector is a first contact image sensor including multiple photosensors aligned in the width direction of the sheet, and the second detector is a second contact image sensor including multiple photosensors aligned in the width direction of the sheet, the second contact image sensor being downstream from the pair of sheet holding rollers in the sheet conveying direction and upstream from the downstream side sheet conveying roller in the sheet conveying direction.

16. The sheet conveying device according to claim 15, wherein, when the controller causes the at least one drive device to move the pair of sheet holding rollers in at least one of the width direction and the rotation direction based on the detection result of the first contact image sensor and the detection result of the second contact image sensor, a lateral displacement amount of the sheet is detected based on a mean value of the lateral displacement amount of the sheet detected by the first contact image sensor and the lateral displacement amount of the sheet detected by the second contact image sensor, and an angular displacement amount of the sheet is detected based on a value obtained by dividing a difference of the lateral displacement amount of the sheet detected the first contact image sensor and the angular displacement amount of the sheet detected by the second contact image sensor by a separation distance of the first contact image sensor and the second contact image sensor in the sheet conveying direction.

17. The sheet conveying device according to claim 15, wherein the pair of sheet holding rollers is a pair of registration rollers configured to convey the sheet at a synchronized time toward an image forming area under control of the controller, and the downstream side sheet conveying roller is a transfer roller configured to contact an image bearer in the image forming area.

18. The sheet conveying device according to claim 11, further comprising:

a pair of sheet conveying rollers configured to function as the discrete gate, the pair of sheet conveying rollers having a drive roller and a driven roller configured to form the nip region together with the drive roller, wherein an angular displacement amount of the sheet is corrected by contacting the leading end of the sheet conveyed toward the pair of sheet conveying rollers to either one of the nip region of the pair of sheet conveying rollers and a projection configured to rotate together with the drive roller.

19. The sheet conveying device according to claim 11, further comprising:

a conveying guide plate upstream from the discrete gate in the sheet conveyance passage in the sheet conveying direction, the conveying guide plate configured to guide the sheet, operable to cause the sheet contacting the discrete gate to bend in the sheet conveying direction; and a movement amount detector configured to detect at least one of a lateral displacement amount of the pair of sheet conveying rollers and an angular displacement amount of the pair of sheet holding rollers.

20. An image forming apparatus comprising:

the sheet conveying device according to claim 11.

21. A sheet conveying device comprising:

a pair of sheet holding rollers configured to convey a sheet, while holding the sheet, in a sheet conveying direction in response to a signal; and a controller configured to generate the signal to instruct at least one drive device to cause the pair of sheet holding rollers to, perform a primary correction operation by instructing the at least one drive device to drive the pair of sheet holding rollers to move, while holding the sheet after a leading end of the sheet contacts a gate, in a width direction based on a detection result from a first detector upstream from the pair of sheet holding rollers in the sheet conveying direction, and perform, after the primary correction operation, a secondary correction operation by instructing the at least one drive device to drive the pair of sheet holding rollers to move in at least one of the width direction and a rotation direction based on a detection result from the first detector and a second detector downstream from the pair of sheet holding rollers in the sheet conveying direction while the pair of sheet holding rollers is holding the sheet.

22. The sheet conveying device according to claim 1, wherein the controller is configured to instruct the at least one drive device to cause the pair of sheet holding rollers to, perform the primary correction in which the pair of sheet holding rollers moves, while holding the sheet, in the width direction based on a lateral displacement amount of the sheet obtained from the position of the sheet indicated in the detection result generated by the first detector, and perform, after the primary correction, the secondary correction in which the pair of sheet holding rollers moves in the at least one of the width direction and the rotation direction based on a subsequent lateral displacement amount of the sheet and an angular displacement amount obtained from the position of the sheet indicated in the detection result generated by the first detector and the position of the sheet indicated in the detection result generated by the second detector.

23. The sheet conveying device according to claim 21, wherein the controller is configured to generate the signal to instruct the at least one drive device to cause the pair of sheet holding rollers to, perform the primary correction operation by instructing the at least one drive device to cause the pair of sheet holding rollers to move, while holding the sheet after the leading end of the sheet contacts the gate, in the width direction based on a lateral displacement amount of the sheet obtained from a position of the sheet indicated in the detection result generated by the first detector, and perform, after the primary correction operation, the secondary correction operation by instructing the at least one drive device to cause the pair of sheet holding rollers to move in the at least one of the width direction and the rotation direction based on a subsequent lateral displacement amount of the sheet and an angular displacement amount obtained from the position of the sheet indicated in the detection result generated by the first detector and the position of the sheet indicated in the detection result generated by the second detector.

* * * * *